US008597133B2

(12) United States Patent
Priester

(10) Patent No.: US 8,597,133 B2
(45) Date of Patent: Dec. 3, 2013

(54) MOTION TRAINING APPARATUS AND METHOD

(76) Inventor: William B. Priester, Jackson, TN (US)

( * ) Notice: Subject to any disclaimer, the term of this patent is extended or adjusted under 35 U.S.C. 154(b) by 740 days.

(21) Appl. No.: 11/376,974

(22) Filed: Mar. 16, 2006

(65) Prior Publication Data

US 2007/0238538 A1 Oct. 11, 2007

(51) Int. Cl.

| | |
|---|---|
| ***A63B 53/06*** | (2006.01) |
| ***A63B 53/16*** | (2006.01) |
| *A63F 9/24* | (2006.01) |
| *A63F 13/00* | (2006.01) |
| *G06F 17/00* | (2006.01) |
| *G06F 19/00* | (2011.01) |

(52) U.S. Cl.
USPC ..... 473/257; 273/317.2; 463/3; 473/131

(58) Field of Classification Search
USPC ..... 473/257
See application file for complete search history.

(56) References Cited

U.S. PATENT DOCUMENTS

| | | | | |
|---|---|---|---|---|
| 4,137,566 | A * | 1/1979 | Haas et al. | 473/209 |
| 5,230,512 | A * | 7/1993 | Tattershall | 473/220 |
| 5,374,063 | A * | 12/1994 | Ogden | 473/220 |
| 5,441,269 | A * | 8/1995 | Henwood | 473/220 |
| 5,467,538 | A * | 11/1995 | Chou et al. | 33/508 |
| 5,494,290 | A * | 2/1996 | Stefanoski | 473/220 |
| 5,694,340 | A * | 12/1997 | Kim | 702/141 |
| 5,772,522 | A * | 6/1998 | Nesbit et al. | 473/222 |
| 6,224,493 | B1 * | 5/2001 | Lee et al. | 473/223 |
| 6,441,745 | B1 * | 8/2002 | Gates | 340/669 |
| 6,739,981 | B1 * | 5/2004 | Lin | 473/219 |
| 7,713,061 | B1 * | 5/2010 | Albertini | 434/252 |
| 2001/0031666 | A1 * | 10/2001 | Knecht | 473/223 |
| 2002/0016213 | A1 * | 2/2002 | Templeton | 473/257 |
| 2002/0177489 | A1 * | 11/2002 | Berish et al. | 473/305 |
| 2004/0097297 | A1 * | 5/2004 | Strite | 473/219 |
| 2005/0079922 | A1 * | 4/2005 | Priester et al. | 473/228 |

* cited by examiner

*Primary Examiner* — Kevin Y Kim
(74) *Attorney, Agent, or Firm* — Luedeka Neely Group, P.C.

(57) ABSTRACT

The invention is directed to a motion trainer for improving a person's movement of an implement by allowing the person to visualize the path of the implement during the movement. The motion trainer comprises an implement having a plurality of motion characteristic sensors located thereon for determining, among other things, the direction of the movement and the orientation of the implement during the movement. Biofeedback devices provide the person information regarding the positioning of the implement during the movement.

45 Claims, 21 Drawing Sheets

| | Over-rotation (O) | Merged (M) | Under-rotation (U) |
|---|---|---|---|
| Behind-the-ideal-shaft-plane (B) | B/O | B/M | B/U |
| In-the-ideal-shaft-plane (I) | I/O | I/M | I/U |
| Front-of--the-ideal-shaft-plane (F) | F/O | F/M | F/U |

*Fig. 2A*

| | Hook (H) | Square (+) | Slice (S) |
|---|---|---|---|
| Error Inside Out (EIO) | EIO/H | EIO/+ | EIO/S |
| Ideal Inside Out (IIO) | IIO/H | IIO/+ | IIO/S |
| Error Outside In (EOI) | EOI/H | EOI/+ | EOI/S |

*Fig. 2B*

MOTION TRAINING APPARATUS AND METHOD

FIELD

This invention relates generally to a motion training apparatus and to methods of improving a desired movement path of an implement. This invention particularly relates to a motion trainer for use by an individual to achieve a proper implement movement plane and to correctly rotate an implement while moving it along a desired path.

BACKGROUND OF THE INVENTION

Many types of activities require that an individual or a machine move an implement in an attempt to successfully accomplish the end goal of participation in such activity. For example, when participating in any of several sporting games, an individual may be required to perform a swinging motion of any of several different implements, each of which is unique to a particular one of the games. Examples of such implements include a bat in the games of baseball and softball, a racket used in the games of tennis and racket ball, and a club used in the game of golf. The performance of a swinging motion of an implement is also required in certain non-sports or work environments such as, for example, the swinging of a maul. Additionally, a multitude of activities require that an individual or a machine move an implement in a non-swinging path to accomplish the end goal of the activity. For example, when writing or painting, an individual is required to move a pen or a brush in the attempt to contact a surface with the point of the pen or the bristles of the brush.

In any of the above-noted activities, an efficient and desired end result, achieved from the movement of the implement, is accomplished when the implement is moved in an ideal path. The ideal path may vary depending on the individual's or machine's height, build, and flexibility. If the individual or machine is aligned properly and is moving the implement at the proper speed along the ideal path, the end result will also be ideal.

In the game of golf, the implement consists of a golf club. Generally, a golf club includes a metal or non-metal-composite shaft having a club head attached to one end of the shaft and a gripping material, referred to as the grip, attached to the shaft at the other end thereof. The general object of the game is for the golfer, by use of the club, to cause a ball to be moved typically from an earthen mound, referred to as the tee, toward and into a small container, referred to as the cup, which is located in a carpet of short grass, referred to as the green, typically several hundred yards from the tee.

Generally, the golfer moves the ball from the tee toward the cup by (1) grasping the grip of the club with both hands, (2) addressing the ball with the club head, which includes aligning a sweet spot of a front, or ball-impact, face of the club head with the ball, (3) raising the club, desirably through an ideal path, in a motion referred to as the backswing, (4) locating the shaft of the club, upon completion of the backswing, in a transitional position behind the head of the golfer, (5) swinging the club forward from the transitional position, desirably returning through an ideal path in a momentum-gathering motion referred to as the downswing, (6) directing the sweet spot of the front face of the club head into impact-engagement with the ball to drive the ball along a desired trajectory and direction, and (7) moving the club away from the impact area and around the opposite side of the golfer's body into a final follow-through position behind the head of the golfer.

The combined motions of the backswing, downswing, and follow-through described above are referred to as a full or complete stroke or a full or complete golf swing. Typically, several strokes by the golfer are required to advance the ball along a path, commonly referred to as the fairway, between the tee and the green, and to its ultimate destination in the cup. Once the golfer's ball rests inside the distance from the cup which requires a full stroke, the golfer begins using shorter strokes in which the backswing completion position and the final follow through position fall short of the same positions in a full stroke. The shortest strokes are employed once the golfer's ball is around or on the green and are referred to as chipping and putting strokes.

When the golfer addresses the ball with the ball-impacting front face of the club head (hereinafter referred to as the club face), the sweet spot of the club face is preferably adjacent and aligned with the ball as noted above. As the golfer begins the backswing, the club head is moved through an arc away from the ball, but desirably maintains an initial arcing alignment between the club face and the ball. At some point during the initial segment of the backswing, there is some degree of rotation of the club shaft such that the club face loses its arcing alignment with the ball. Normal human anatomy does not permit a full swing of the golf club without this club shaft rotation.

As the golfer swings the club through the downswing of the stroke, the golfer must effectively rotate the club in the reverse direction, preferably just before impact with the ball, to return the club face to arcing alignment with the ball. Preferably, following movement of the club through the backswing and downswing, the golfer should return the club face through the ideal path to the impact position, with the momentum necessary to effectively strike and carry the ball in an ideal trajectory and distance. Following impact, the club face maintains an arcing alignment with the ball for a short distance, followed by a club shaft rotation in an opposite direction from that which occurred during the backswing. This rotation is necessary given the limitations of human anatomy so that the club may be moved to the final follow-through position.

While it is a practically impossible to accomplish a perfect golf swing each and every time a golfer swings the club to impact the ball, several professional golfers seem to accomplish a near perfect swing on a reasonably consistent basis. Even so, there remains a need for a device and methods that will enable the golfer, or any one swinging an implement, to swing the club or other implement more consistently along an ideal path.

SUMMARY OF THE INVENTION

In golf, the ideal backswing plane has been described as being like a sheet of glass resting on the golfer's shoulders and extending to the golf ball. The ideal downswing plane has been described as the sheet of glass having a flatter angle than that of the ideal backswing plane and being rotated for a more inside to outside club head path. The ideal club shaft path during the backswing has also been described as being curved instead of traveling in a true plane. Although the backswing and downswing planes can be conceptualized and described, there remain significant problems in helping the average golfer find their ideal swing plane.

This invention encompasses new terminology describing opposing muscle groups that control the golf swing. A first set of opposing muscle groups include a behind-the-ideal swing plane muscle group and a front-of-the-ideal swing plane muscle group. For simplicity, these terms are abbreviated to the behind-the-plane muscle group and the front-of-the-plane muscle group. These opposing muscle groups are located in the hands and forearms. For a right-handed golfer, the behind-the-plane muscles are in the palm of the left hand, the inner aspect of the left forearm, back of the right hand, and the outer aspect of the right forearm. The front-of-the-plane muscles are in the back of the left hand, the outer aspect of the left forearm, the palm of the right hand, and the inner aspect of the right forearm.

To achieve an ideal swing plane, there must be excellent balance between the behind-the-plane muscle group and the front-of the-plane muscle group. These two opposing muscle groups can be conceptualized as being in a tug-of-war, with each muscle group being at respective ends of an imaginary rope. The best position to view the over-action or under-action of the two muscle groups is to look at a golfer's swing down the target line. The target line is the line extending from the golfer's ball to the golfer's point of aim. From this viewpoint, over-action of the behind-the-plane muscle group will move the club too far behind the golfer's body during the backswing. This behind-the-plane muscle group over-action produces a behind-the-plane error. Over-action of the front-of-the-plane muscle group will keep the club too far in front of the body during the backswing. This front-of-the-plane muscle group over-action produces a front-of-the-plane error.

A second set of opposing muscle groups includes a counter-clockwise rotary muscle group and a clockwise rotary muscle group. When viewing a golfer in a face-to-face perspective, the counter-clockwise rotary muscle group is responsible for rotating the clubface in a counter-clockwise direction. In a face-to-face perspective, counter-clockwise rotation of the clubface results in the clubface being rotated toward the golfer's right side and the viewer's left side. The clockwise rotary muscle group is responsible for rotating the clubface in a clockwise direction. In a face-to-face perspective, clockwise rotation of the clubface results in the clubface being rotated toward the golfer's left side and the viewer's right side.

To visualize how the first and second sets of opposing muscle groups work together, a new concept—two plane merger—is introduced herein. To make visualization of two plane merger possible, a new term—club shaft plane—is used herein instead of the terms swing plane and club shaft path. The ideal club shaft path is different for each golfer depending on the golfer's height, build, and flexibility. The ideal club shaft path is usually curved because it is anatomically very difficult if not impossible for a human being to swing a golf club through a full stroke while keeping the club shaft path in a true plane. Hence, it is correct to state that the club shaft path cannot exist in a true plane.

There are an infinite number of singular points of position of the club shaft along the golf club's path of travel throughout the entire swing. At each of these points, there is a singular club shaft plane which rests in the spatial field representing the direction of travel of the club shaft for that point only. For simplicity, the composite of this infinite number of singular club shaft planes is referred to as the club shaft plane. It could also be called the composite club shaft plane. For each golfer, there are ideal club shaft planes for the backswing, downswing, and follow-through which may vary slightly depending on the type of shot being played.

The other plane in two plane merger is the club face plane. Regardless of the loft of the actual ball-striking club face, the club face plane represents the position of the club face as if the club face had zero degrees of loft. Unlike the club shaft plane which has some degree of curvature, the club face plane is appropriately termed a true plane since it is an extension of the zero degree club face.

At the address, or six o'clock position, the club face plane is ideally a vertical plane which is essentially perpendicular to the club shaft plane. During the backswing of a right-handed golfer, viewed in a face-to-face perspective, the club face plane is rotated in a counter-clockwise direction about the axis of the club shaft. In an ideal two plane merger swing, somewhere between the eight o'clock and ten o'clock backswing positions, the club face plane has been rotated in a counter-clockwise direction so that the club face plane merges, and is co-planar, with the actual club shaft plane. This ideal rotation of the club face plane results in what is referred to as a merged position. The merged position represents a mechanically efficient club face plane orientation in which the club face plane can slice through the air in an aerodynamic fashion.

The term actual club shaft plane is used instead of ideal club shaft plane to demonstrate that proper two plane merger can occur in both an ideal club shaft plane or in any less-than-ideal club shaft plane. Of course, an ideal state of motion within the two plane merger theory is achieved only if ideal two plane merger occurs in an ideal club shaft plane. At the backswing completion position and during the downswing, the club face plane should remain merged with the club shaft plane until just before impact when the club face plane is rotated in a clockwise direction to achieve an impact position of the club face plane. The ideal club face plane impact position is perpendicular to the club face plane and is much more likely to occur if ideal two plane merger has occurred in an ideal club shaft plane. The relationship of the club face plane and the club shaft plane during the follow-through should approximate the mirror image of the relationship of the two planes during the backswing with a remerger of the two planes occurring between the four o'clock and six o'clock positions. The actions described above define the two-plane-merger golf-swing theory in accordance with a preferred embodiment of the invention. It follows that the two plane merger zone of the golf swing exists above the substantially horizontal line connecting the nine o'clock backswing position and the three o'clock follow-through position. The zone of the golf swing below this horizontal line is referred to as the two plane perpendicular zone or impact zone.

Errors within the two-plane-merger zone of the golf swing are referred to as demerger errors and can occur in addition to or without behind-the-plane errors or front-of-the-plane errors. During the backswing, these demerger errors occur when the club face plane rotation is either less than what is necessary to achieve two plane merger or greater than what is necessary to achieve two plane merger. If the angle of club face plane rotation is less than what is necessary to achieve two plane merger, the club face is said to be in a closed or shut position. For a right-handed golfer, over-action of the clockwise rotary muscle group is referred to as an under-rotation error or as under-rotation and produces a closed or shut club face. For a left-handed golfer, over-action of the counter-clockwise rotary muscle group is referred to as an under-rotation error or as under-rotation and produces a closed or shut club face. When the angle of rotation is greater than what is needed to achieve two plane merger, the club face is said to be in an open position. For a right-handed golfer, over-action of the counter-clockwise rotary muscle group is referred to as an over-rotation error or as over-rotation and produces an open club face. For a left-handed golfer, over-action of the clockwise rotary muscle group is referred to as an over-rotation error or as over-rotation and produces an open club face.

The downswing relationships of the two planes are greatly affected by the backswing relationships. Ideal movement of the club face through the impact area is much easier to accomplish if ideal two plane merger is maintained until the nine o'clock downswing position is reached during the downswing. For a right-handed golfer, ideal ninety degree clockwise rotation of the clubface plane during the final portion of the downswing will result in an ideal club face position at impact. This ideal club face position at impact is referred to as a square club face at impact or squaring of the club face at impact. If the downswing is initiated with the club face plane in an under-rotated position, then less than ninety degrees of club face plane rotation will be needed to square the club face at impact. Similarly, if the downswing is initiated with the club face plane in an over-rotated position, then greater than ninety degrees of club face plane rotation will be needed to square the club face at impact. Any failure to square the club face at impact is referred to as a rotational impact error.

To prevent demerger errors, behind-the-plane errors, front-of-the-plane errors, rotational impact errors, or any combination thereof, the golfer must consistently and patiently train to find the proper swing. If the only feedback is the trajectory and distance traveled of a golf ball which has been struck by a golf club, this training requires extensive trial and error.

The present invention allows a golfer to effectively and realistically visualize the plane and rotation of the golf club during the golf swing. The invention accomplishes this by simultaneously representing the club face plane and the club shaft plane throughout the swing as well as providing other types of real time biofeedback to the golfer.

One embodiment of the invention provides a swing trainer wherein the club face plane is represented by light emitting strips disposed 180 degrees apart on the front and back of the club shaft. These strips may be rows of lasers or similar linear or planar light emitting devices. The club shaft plane is represented by light emitting material that covers the rest of the club shaft between the club face plane illuminating strips. In this embodiment, a planar strip of light emitting or conducting material extends outward from the distal end of the club shaft to the sole of the club head within the club face plane. Preferably, a light emitting strip is also disposed on the sole of the club head to complete the circle of illumination within the club face plane around the club head.

To facilitate viewing of the two planes from all angles, a second club head is positioned on a very short extension of the shaft from the grip end of the implement. This proximal second club head is identical in appearance and orientation, to the distal ball-striking club head although it may be made of a much lighter material as it will not be used to strike a ball. The proximal club head improves viewing of the club face plane and club shaft plane from all points of observation, especially when viewing the swing from a position looking down the target line. When the swing is viewed from this down the target line position, the proximal club head prevents body parts and more proximal parts of the implement from blocking visualization of the club face plane and club shaft plane during the backswing-completion portion of the swing.

The swing trainer can be used alone to enhance the quality of a video of the golfer's swing or a computing device can use the video data to generate video representations of the relationship between the club face plane and the actual club shaft plane as well as the relationship of the actual club shaft plane to the ideal club shaft plane. Real time aural or physical biofeedback can also be delivered to the trainee by the computing device through biofeedback devices.

In another embodiment, the swing trainer comprises an elongate body for being swung by the person, and one or more swing characteristic sensors disposed on the body for determining characteristics of the body during the swing. A computing device coupled to the swing characteristic sensors generates biofeedback information based on the sensed characteristics of the body during the swing. The swing trainer includes one or more biofeedback devices coupled to the computing device for providing the biofeedback information regarding the swing.

The biofeedback devices may comprise light emitting devices. The light emitting devices are preferably located in columns that correspond to the club face plane and the club shaft planes of the implement. The columns in the club face plane may be of a different color than those in the club shaft plane. The light emitting devices may be lasers, LEDs or other devices. Visual biofeedback may also include visual representation of the swing displayed on a video display device. This visual representation of the club face plane, actual club shaft plane, and ideal club-shaft plane can also be generated by the computer without light emitting devices located on the implement. These computer generated images are superimposed on the swing video. The video display device may be a video screen, video goggles, or other video display devices.

The biofeedback devices may also provide aural or physical biofeedback to a person with or without visual biofeedback.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein:

FIG. 2A depicts a probability diagram representing nine states of motion in the two plane merger zone of the golf swing;

FIG. 2B depicts a second probability diagram representing nine states of motion in the impact zone of the golf swing;

DETAILED DESCRIPTION OF PREFERRED EMBODIMENTS OF THE INVENTION

Figure 1:
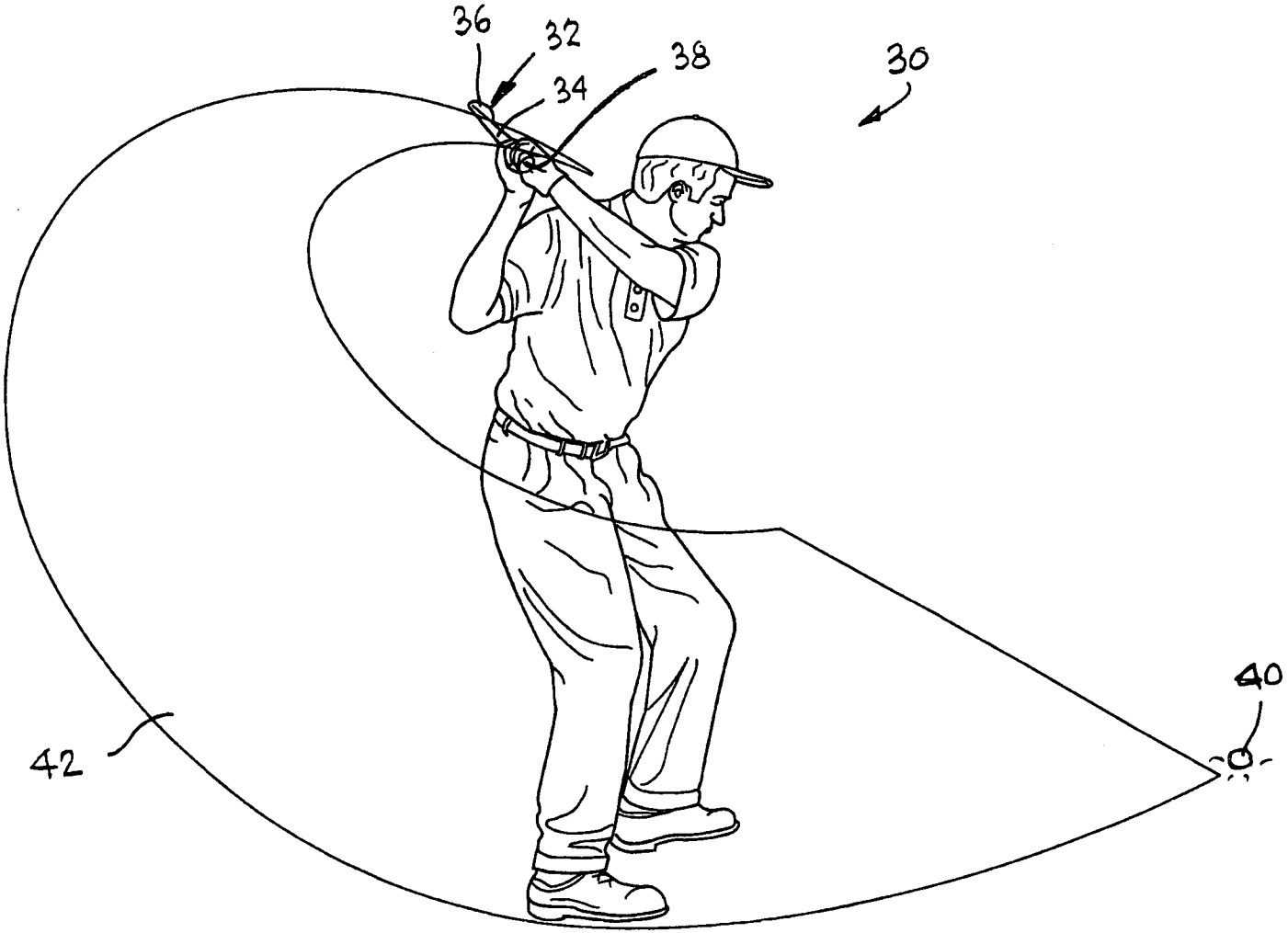
FIG. 1 is a perspective view showing a golfer having moved a golf club fully through a backswing to a backswing-completion position (hereinafter referred to as the three o'clock position by viewing the club shaft as being the hand of a clock) and through a generally C-shaped path.

Referring to FIG. 1, a golfer 30 has completed a backswing of a golf club 32, with the club being at the peak of the backswing, or backswing-completion position, and poised for the beginning of a downswing of the club. The club 32 includes a club shaft 34 extending between a distal end and a proximal end of the club. A club head 36 is mounted on the distal end of the shaft 34, and a grip 38 is formed about a portion of the shaft at or near the proximal end of the shaft. In referring to the club shaft as the hand of a clock, the backswing completion position can also be referred to as the three o'clock toe down position. The terms "toe down" refer to the toe or outer region of the club head being positioned in a downward direction. Toe down distinguishes this three o'clock position from the other three o'clock position which occurs during the follow-through in which the toe is located in an upward direction.

The grip 38 typically extends from the proximal end of the shaft 34 towards the distal end of the shaft, and terminates at an intermediate portion of the shaft 34. In preparation for swinging the club 32, the golfer 30 positions the golfer's hands on the grip 38 in a conventional club-gripping manner, whereby the thumb of one hand, for example, the right hand, is closer to the inboard end of the grip 38 than the thumb of the other hand. For description purposes, the thumb which is closer to the inboard end of the grip 38 is referred to herein as the inboard thumb.

Prior to initiating the backswing, the golfer 30 places the golfer's hands around the grip 38 in the conventional golf-gripping manner, and addresses the golf ball 40 at an address position (six o'clock position) to align a sweet spot of the club head 36 with the ball 40.

During the backswing movement of the club 32 from the six o'clock position to the backswing-completion position illustrated in FIG. 1, the golfer 30 moves the club shaft 34 through a generally C-shaped path 42 along which exist an infinite number of singular club shaft planes the composite of which is referred to herein as the club shaft plane. The ideal club shaft plane during the backswing has a curved nature and will be different for each golfer depending on their physique and flexibility. The ideal club shaft plane flattens and rotates at the initiation of the downswing to create a separate and distinct ideal downswing club shaft plane. The golfer's ability to generate an ideal downswing club shaft plane is largely dependent on the golfer's ability to maintain an ideal backswing club shaft plane. By maintaining the club within these ideal club shaft planes, the golfer is more likely to strike the golf ball with the sweet spot of the club face to attain the desired trajectory and direction of the ball.

While professional golfers occasionally make errant shots, such shots are infrequent. With their inherent ability, training regimen, muscle balance and muscle memory patterns, the professionals consistently make shots which attain the desired trajectory and direction of travel of the ball. However, most other golfers continuously wrestle with the nagging problem of being unable to swing the golf club 32 in such a manner that the lofty goal of consistent and desired ball trajectory and direction is unattainable. While it is unlikely that most non-professional golfers will ever attain the inherent ability demonstrated by professional golfers, the non-professional golfers can improve their game through proper training in the swinging of a golf club.

As a starting point, in order to attain the desired result, the golfer 30 must possess the ability to properly grip the club 32, and to maintain an appropriate stance and posture when swinging the club. Then, the golfer 30 must swing the club 32 in the correct plane through the backswing and downswing, while properly rotating the club 32.

FIG. 2A represents nine potential states of motion in the two plane merger zone of the golf swing. For the backswing, the nine squares refer only to the portion of the backswing which extends from the point at which club face plane rotation has ended (eight o'clock to ten o'clock) to the point of completion of the backswing (three o'clock toe down). The central probability square (I/M) represents a state of ideal motion for this segment of the backswing in which the golf club is located in an ideal club shaft plane and ideal two plane merger is being maintained. The other eight probability squares represent states of improper motion.

For the downswing, the nine squares of FIG. 2A refer only to the portion of the downswing which extends from the backswing completion position (three o'clock toe down) to the point at which club face plane rotation begins its rapid acceleration phase in the impact zone. The impact zone extends from around the nine o'clock downswing club shaft position through the three o'clock follow-through club shaft position. In the downswing segment between three o'clock toe down and nine o'clock, most golfers tend to maintain the state of motion they were in during the same segment of their backswing (nine o'clock to three o'clock toe down).

As rapid club face plane rotation begins in the impact zone, a second probability diagram, shown in FIG. 2B, represents the position of the club face plane (x axis) and club shaft plane (y axis) at impact. Ideally, the club face plane should return to a position ninety degrees away from the club shaft plane at impact. This position is referred to as the squared position or being square at impact (+). The other two impact positions are the slice position (S) and the hook position (H). The slice position refers to the state of motion in which club face plane rotation has fallen short of the square position. This position is also referred to as the open club face position at impact. The hook position refers to the state of motion in which club face plane rotation has progressed past the square position. This position is also referred to as the closed club face position at impact.

For a stroke in which the club is swung into the impact zone behind the ideal club shaft plane, the club face will approach the ball on a path which is too inside to outside the target line. This non-ideal inside to outside the target line approach can also be called non-ideal inside out and in this instance means the clubface approaches the ball from too far inside the target line, crosses the target line at impact, then moves too far outside the target line after impact. Since this is an error state of motion, it can also be called error inside out (EIO).

For a stroke in which the club is swung into the impact zone in the ideal club shaft plane, the club face will approach the ball on a path which is just slightly inside out. This state of motion is called ideal inside out (IIO).

For a stroke in which the club is swung into the impact zone in front of the ideal club shaft plane, the club face will approach the ball on a path which is outside in. This means the club face approaches the ball from outside the target, crosses the target line at impact, then moves inside the target line after impact. This state of motion is called error outside in (EOI). EOI includes the potential path in which the club face approaches the ball on a path down the target line.

The nine states of motion represented in the nine probability squares of FIG. 2B produce shots referred to as follows: EIO/S →"push slice"; EIO/+→"push"; EIO/H→"push hook"; IIO/S→"fade"; 110/+→"draw"; IIO/H→"hook"; EOI/S→"pull slice"; EOI/+→"pull"; and EOI/H→"pull hook". Obviously, a straight shot has been left out and for good reason. A perfectly straight shot means a square club face has approached the ball on the target line and stayed on the target line through impact. For a full stroke, this straight trajectory is very hard to reproduce and is not usually a goal for the professional golfer. Professional golfers like to see shape in their shots and usually prefer either a fade or a draw as their standard trajectory. They make adjustments in their swings to produce different and more dramatic shape as the specific shot warrants.

The probability grids of FIGS. 2A and 2B can be superimposed on one another as the state of motion located in a certain square in FIG. 2A will usually produce the state of motion located in the same square in FIG. 2B.

Other potential errors which are not represented in FIGS. 2A and 2B include errors related to stance and posture, alignment, arc of the swing and tempo of the swing. If any single error or any combination of errors exists at any point in time in a golfer's swing, the implement and its various biofeedback options can be used to correct the errors. Theories representing different concepts of what an "ideal golf swing" should look like can be represented by their own unique probability diagrams. Regardless of the nature of the "ideal golf swing" sought after by the golfer and/or their teaching professional, the present invention can be used to attain it.

Figure 3:
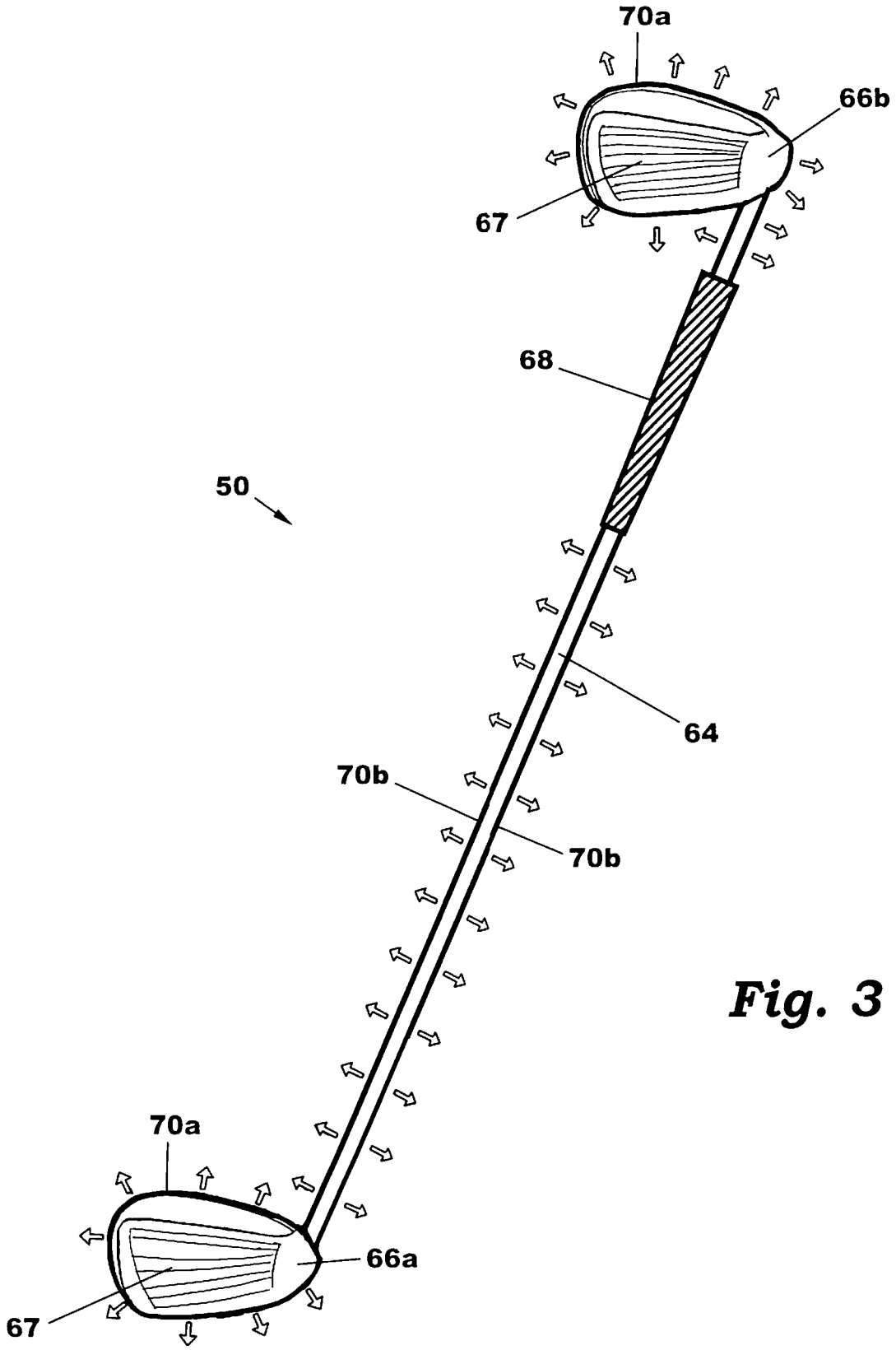
FIG. 3 is a side view of a swinging implement of a swing trainer according to one embodiment of the invention.

With reference to FIG. 3, there is shown a swing trainer 50 according to one embodiment of the invention for assisting a golfer in developing an ideal swing. The swing trainer 50 includes a substantially tubular club shaft 64 extending between a distal end and a proximal end thereof. A distal club head 66*a* is mounted at the distal end of the shaft 64 and a proximal club head 66*b* is mounted at the proximal end. The distal club head 66*a* may comprise any of a variety of club heads known in the game of golf, including woods, irons, or even a putter, and is intended to actually strike the ball while using the swing trainer. Although the proximal club head 66*b* is preferably an exact replica of the distal club head 66*a*, the proximal club head 66*b* can be made of a much lighter material as it is used for biofeedback purposes only. The proximal club head 66*b* is positioned in an identical spatial orientation to the club shaft as the distal club head. The only difference is the direction which the club shaft 64 extends from the hosel of the club head. For the distal club head 66*a*, the club shaft 64 extends above the club head. For the proximal club head 66*b*, the club shaft 64 extends below the club head.

Preferably, a grip 68 is formed about a portion of the shaft at or near the proximal end of the shaft. The grip 68 typically extends from the proximal end of the shaft 64 toward the distal end of the shaft 64 and terminates in an intermediate portion of the shaft. In alternative embodiments, the grip may be any grip suitable for a swing trainer 50 or the swing trainer 50 may have no grip.

Figure 4:
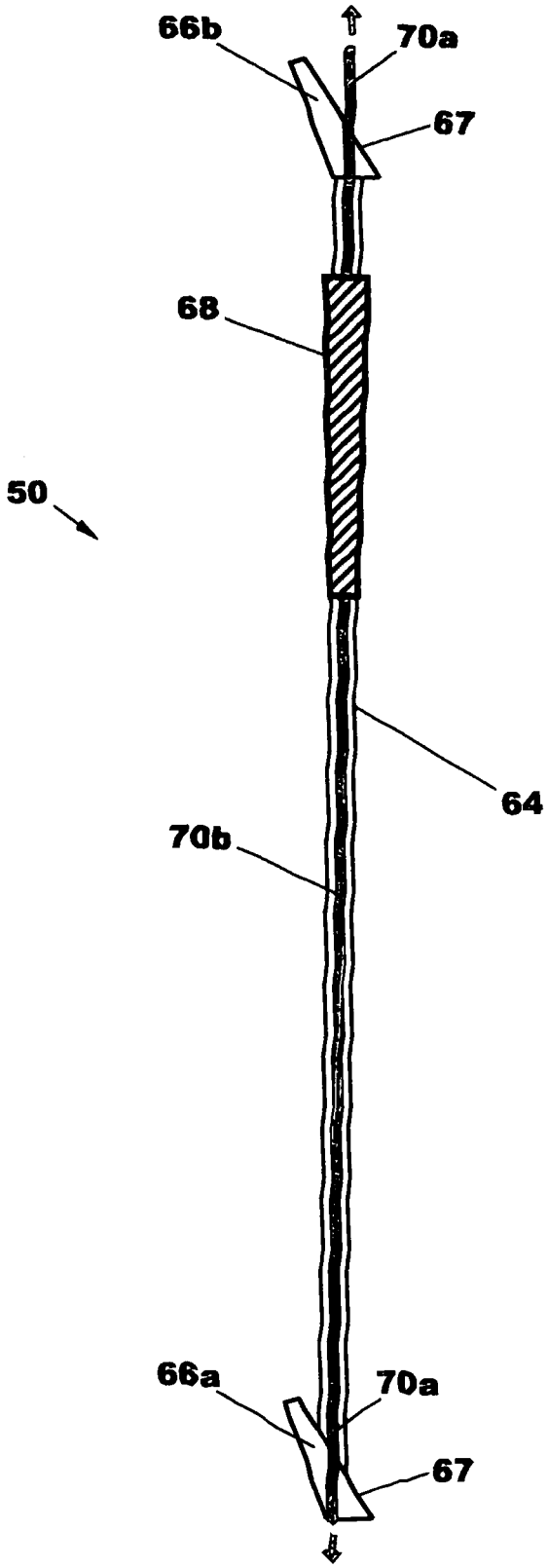
FIG. 4 is a front view of a swinging implement of a swing trainer according to one embodiment of the invention.
Figure 5:
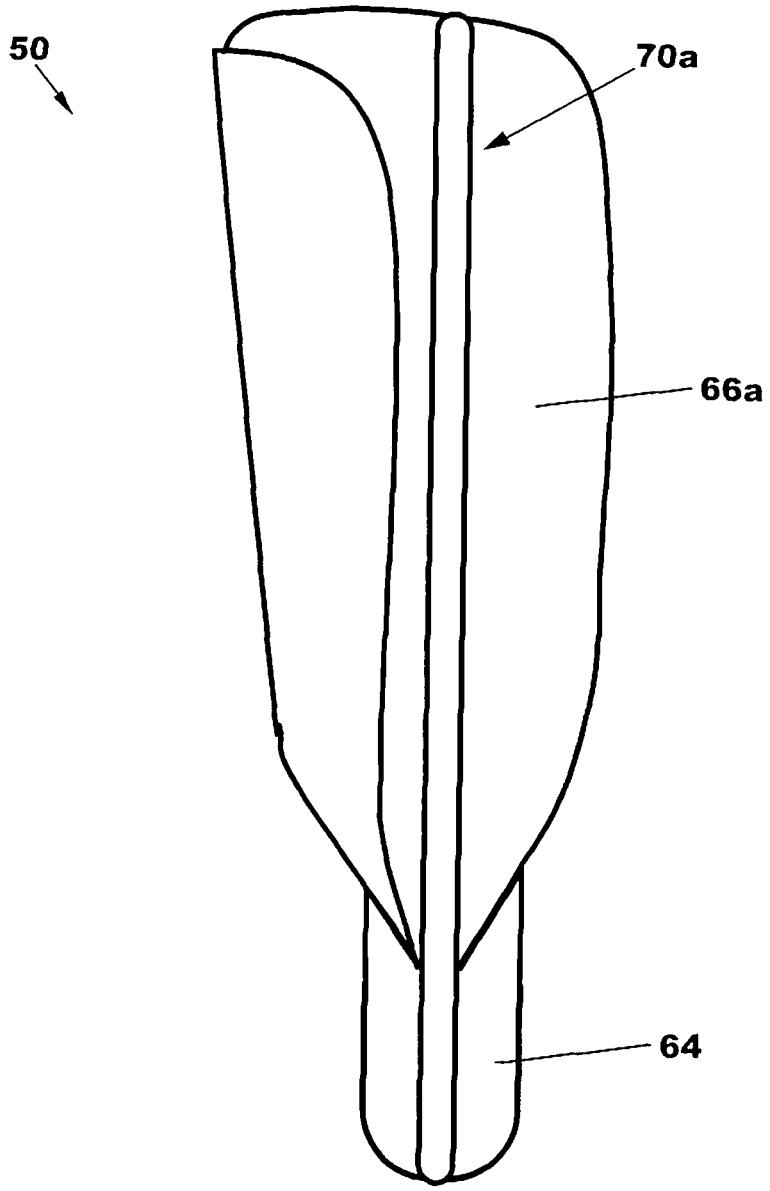
FIG. 5 is a bottom view of the distal end of a swinging implement of a swing trainer according to one embodiment of the invention.
Figure 6:
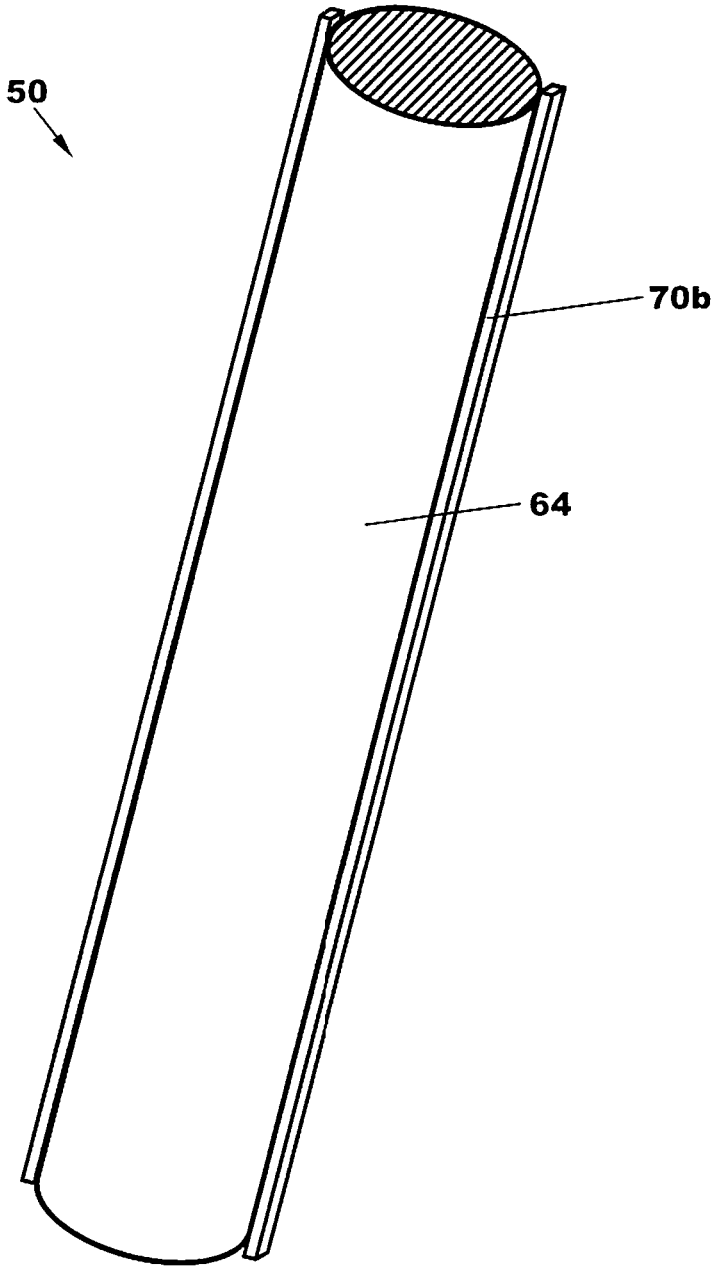
FIG. 6 is a perspective view of a portion of a club shaft of a swing trainer according to one embodiment of the invention showing light emitting structures in the club face plane.

As shown in FIGS. 3, 4 and 5, a light emitting strip of material 70*a* extends in a circumferential fashion around the club heads 66*a* and 66*b* in the club face plane of the swing training implement 50. This loop of light emitting material 70*a* is positioned around both club heads such that the golfer can strike the ball with the distal club head 66*a* of the implement 50. Preferably, the loop 70*a* projects red light or any other color of light in a plane which corresponds to the club face plane, thereby enabling good visualization of the club face plane throughout the swing.

When visualizing the club head during the swing without loop 70*a* attached to club heads 66*a* and 66*b*, the golfer has to guess where the club face plane is located while looking at an actual ball-striking face of the club which extends in a plane that is angled away from the club face plane. The golf industry refers to this angular deviation as the loft of the ball-striking club face. Loft increases as the number of the club increases. A driver, which can also be referred to as club number one, usually has a loft of ten degrees. A pitching wedge, which can also be referred to as club number ten, usually has a loft of forty eight degrees. This means that it is harder for a golfer to guess where the club face plane is located when swinging a wedge than it is to do the same guess work when swinging a driver.

As shown in FIGS. 3, 4, 5 and 6, the strip of light emitting material 70*b* runs the length of the shaft 64. Strip 70*b* also projects light into the club face plane to further aid the user in visualizing the relationship between the club face plane and the club shaft plane. In the side view of FIG. 3, the light emitted from strips 70*a* and 70*b* is projected into the plane parallel to the page. FIG. 4 provides a front view of the club heads 66*a* and 66*b* with strips 70*a* and 70*b* emitting light in the club face plane which is perpendicular to (coming out of) the page. FIG. 5 is a bottom view of the sole of the distal club head 66*a* with strips 70*a* and 70*b* emitting light perpendicular to the page. The strips 70*a* and 70*b* may comprise a string of LED's, one or more lasers and associated optics, a flat panel light emitting structure, a flexible organic light emitting device (FOLED), or other light emitting structures known in the art.

The club shaft 64 is preferably covered with a light emitting material, such as a flexible organic light emitting device (FOLED). As will be appreciated by one skilled in the art, an organic light emitting device may be formed on a flexible base material, such as clear plastic film or reflective metal foil, which may be applied to the outer surface of the shaft 64. In a preferred embodiment, the light emitting material on the shaft 64 emits yellow light. It should be appreciated that practically any other color could be used.

Figure 7:
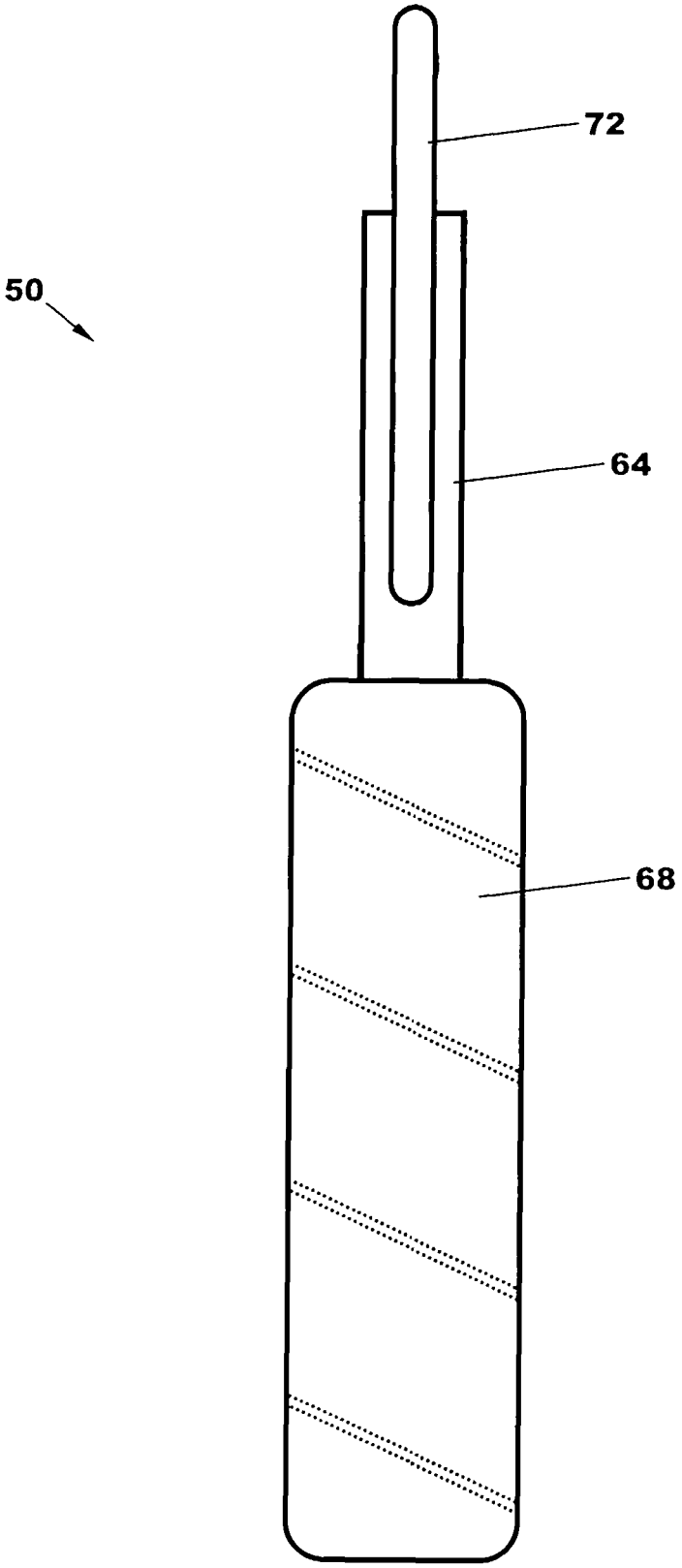
FIG. 7 is a front view of the proximal end of a swinging implement of a swing trainer according to an alternative embodiment of the invention.
Figure 8:
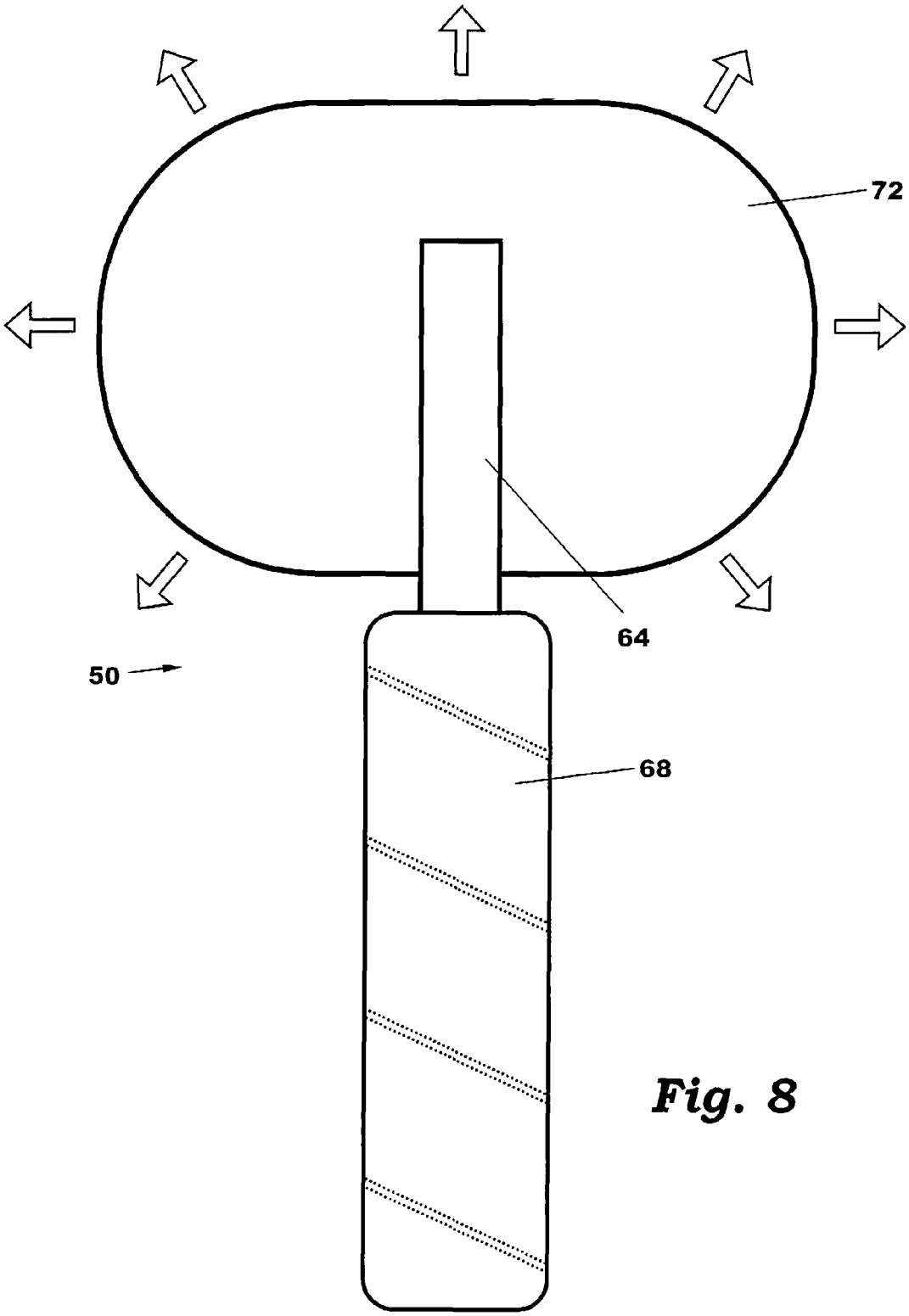
FIG. 8 is a side view of the proximal end of a swinging implement of a swing trainer according to an alternative embodiment of the invention.
Figure 9:
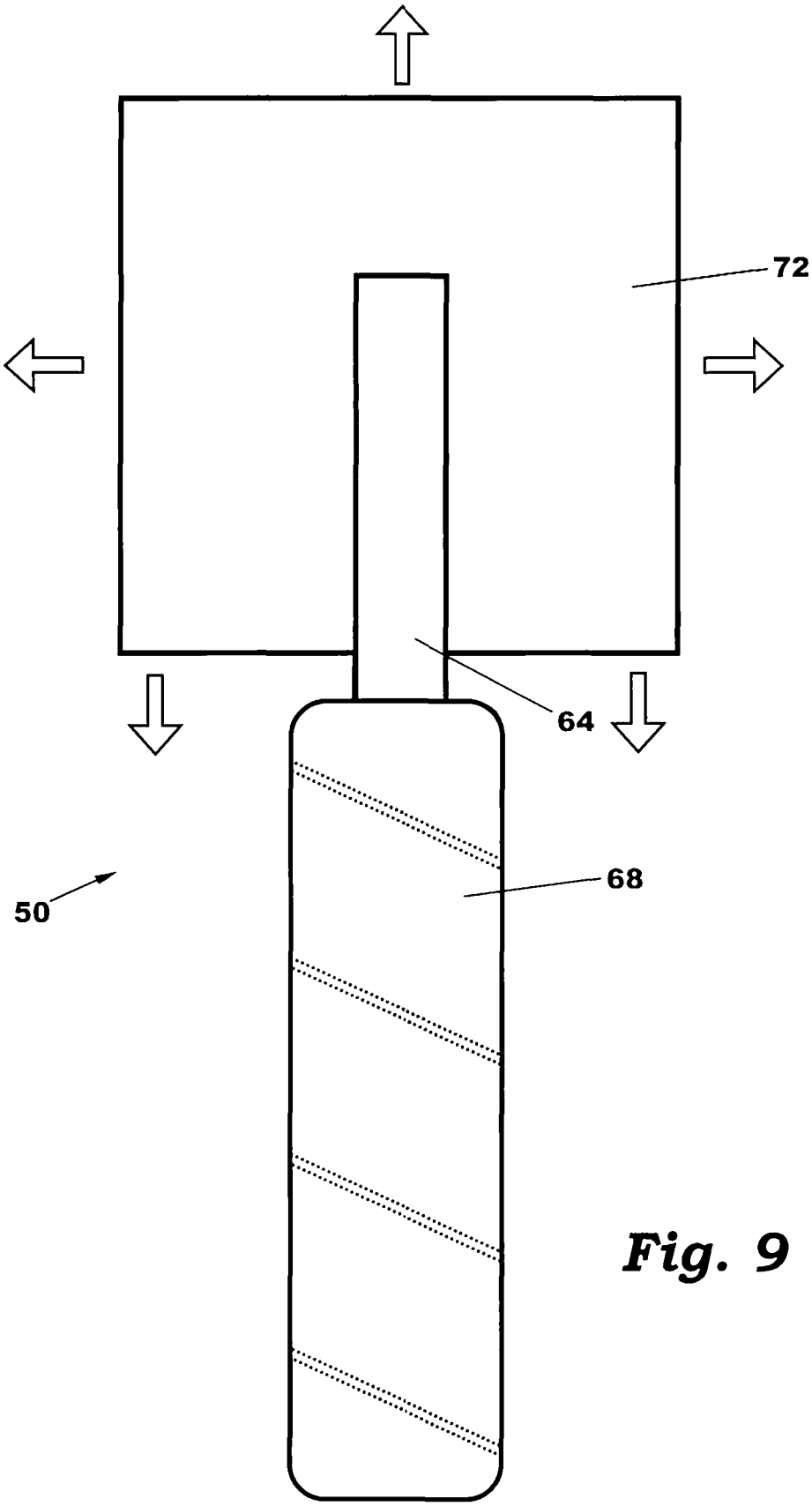
FIG. 9 is a side view of the proximal end of a swinging implement of a swing trainer according to an alternative embodiment of the invention.

In alternative embodiments, an element other than a club head may be located on the proximal end or the distal end of the shaft. These alternative elements may have a variety of different configurations which are suitable for improving the golfer's visualization of the club face plane. FIGS. 7, 8 and 9 depict examples of such alternative embodiments of the invention wherein the proximal club head has been replaced with a light emitting planar structure 72 that emits light into the club face plane which coincides with the plane of the structure 72. This emitted light is perpendicular to the plane of the page in FIG. 7 and is parallel to the plane of the page in FIGS. 8 and 9. In FIG. 8, the structure 72 is substantially circular, and in FIG. 9, the structure 72 is substantially square. For simplicity, only proximal end alternatives are illustrated. It will be appreciated however that a light emitting planar structure 72 may also be provided at the distal end of the shaft 64.

Figure 15:
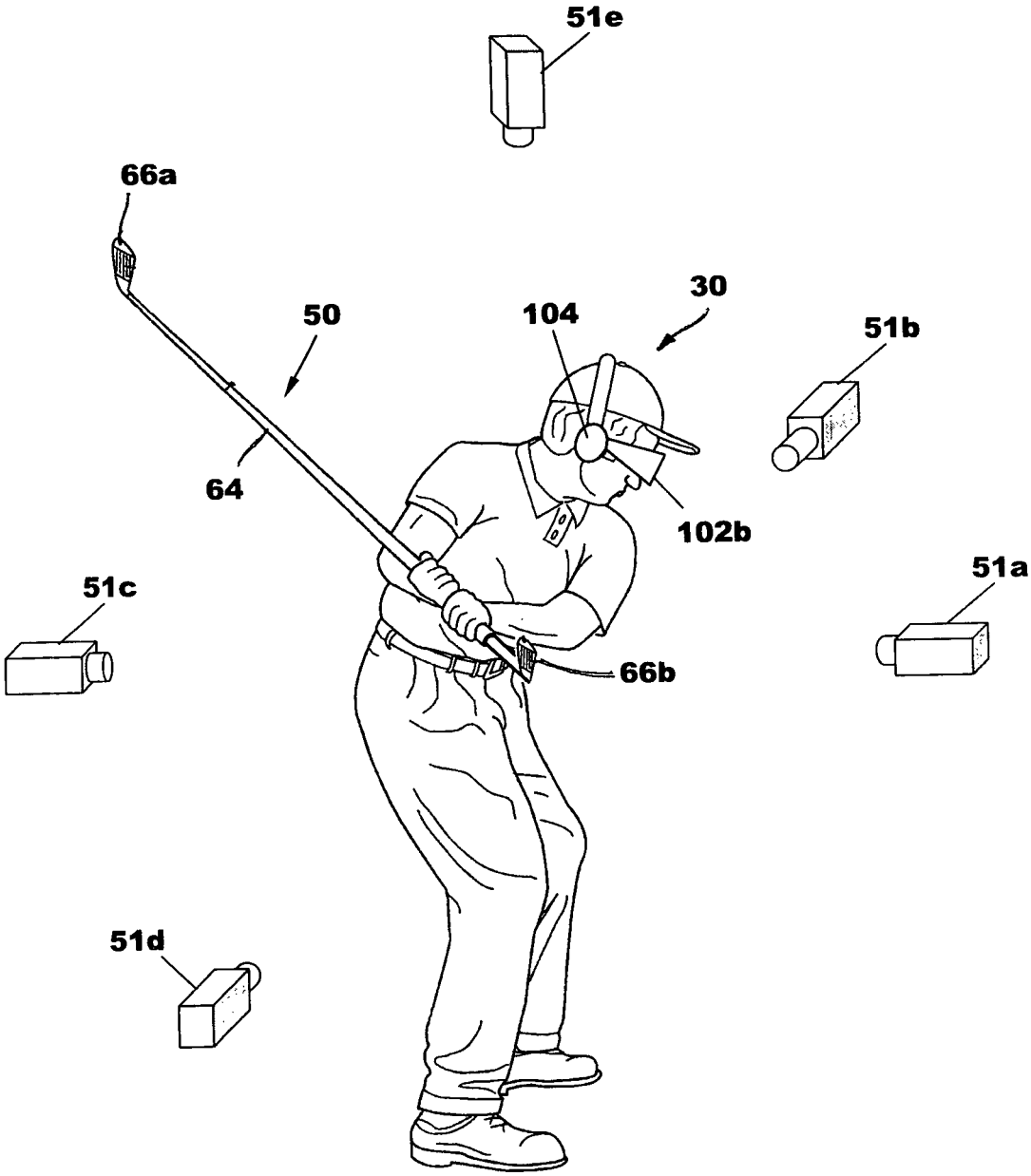

Some embodiments of the invention include swing characteristic sensors for measuring information indicating the various positions of the club shaft 64 during a swing. For example, as shown in FIG. 15, the swing characteristic sensors may comprise one or more video cameras 51*a*-51*e*. As shown in FIG. 11B, video images captured by the cameras 51*a*-51*e* are provided to a computer 53 which uses the video image data to generate biofeedback. One important function of the computer is to use the video image data, such as the videographic streak of yellow light created by movement of the club shaft 64, to determine the actual club shaft plane. The cameras 51*a*-51*e* and computer 53 can also be used to capture and record video images of ideal backswing, downswing, and follow-through club shaft planes as the golfer is assisted by the teaching pro in moving the swing trainer through an ideal swing. In this manner, the relationships of the club face plane to the actual club shaft plane and the actual club shaft plane to the ideal club shaft plane can be studied and modified with different types of biofeedback devices 55 as disclosed for various embodiments described herein.

Figure 10:
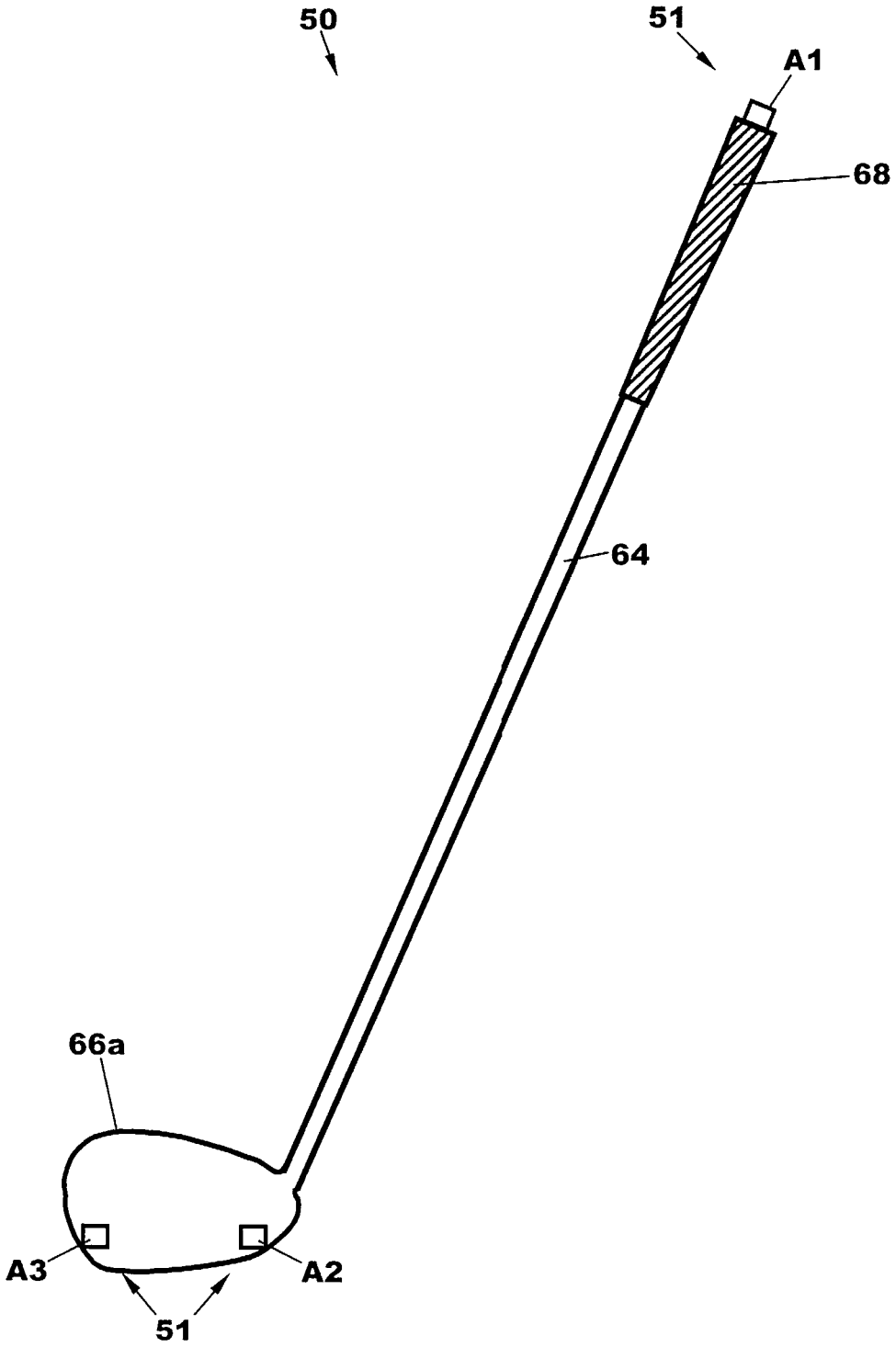
FIG. 10 depicts a swinging implement of a swing trainer according to a preferred embodiment of the invention.

With reference to FIG. 10, a preferred embodiment of the training device 50 includes one or more swing characteristic sensors 51 attached to the shaft 64 for sensing direction and velocity characteristics of a swing. In one preferred embodiment of the invention, the swing characteristic sensors 51 comprise accelerometers that sense acceleration of the club 64 and club head 66*a* in three orthogonal axes. As shown in FIG. 10, the accelerometers are preferably packaged in accelerometer assemblies A1, A2 and A3 positioned near the outboard end of the grip 68, the rear edge or heel of the club head 66*a* and the forward edge or toe of the club head 66*a*, respectively. In this manner, three-dimensional acceleration vectors may be measured with respect to at least three points on the shaft.

The accelerometer assemblies A1, A2 and A3 are preferably incorporated into the normal structure of each of a player's clubs so that the clubs can be used to strike the ball in a normal fashion during an actual round of golf. This allows biofeedback training to occur during an actual round. The swing data from the round can also be used for more detailed study after the round including comparison to swing data from other actual rounds of golf. This can also provide television commentators a means of providing their viewing audience a detailed analysis of shots played by professional golfers. This television analysis can be provided by the commentators in a real-time fashion and/or in a replay mode for more careful study. Individual viewers can also be offered various options allowing them to analyze each shot in real-time or playback fashion without input from the commentators.

Figure 11A:
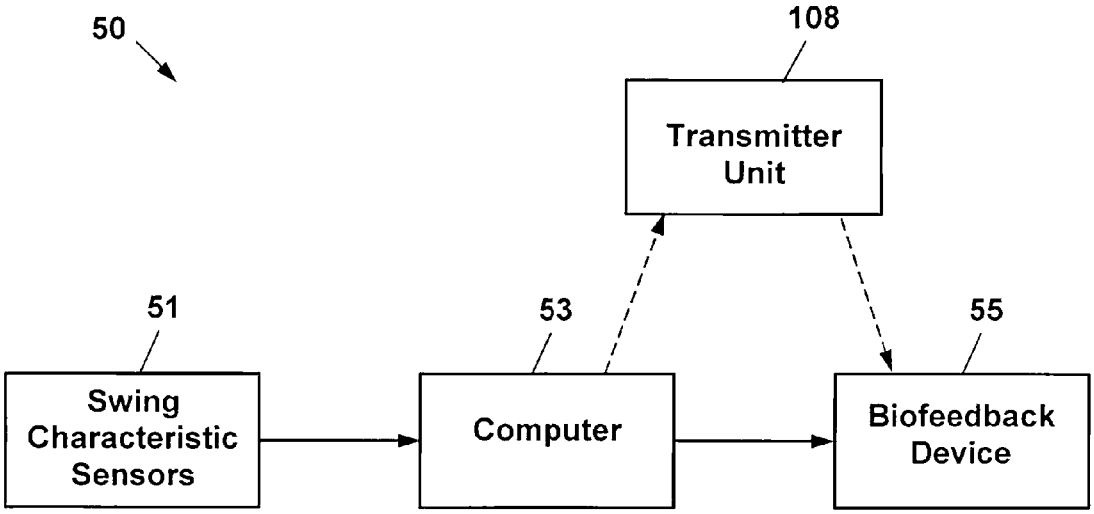
FIGS. 11A and 11B depict functional block diagrams of swing trainer apparatuses according to preferred embodiments of the invention.
Figure 11B:
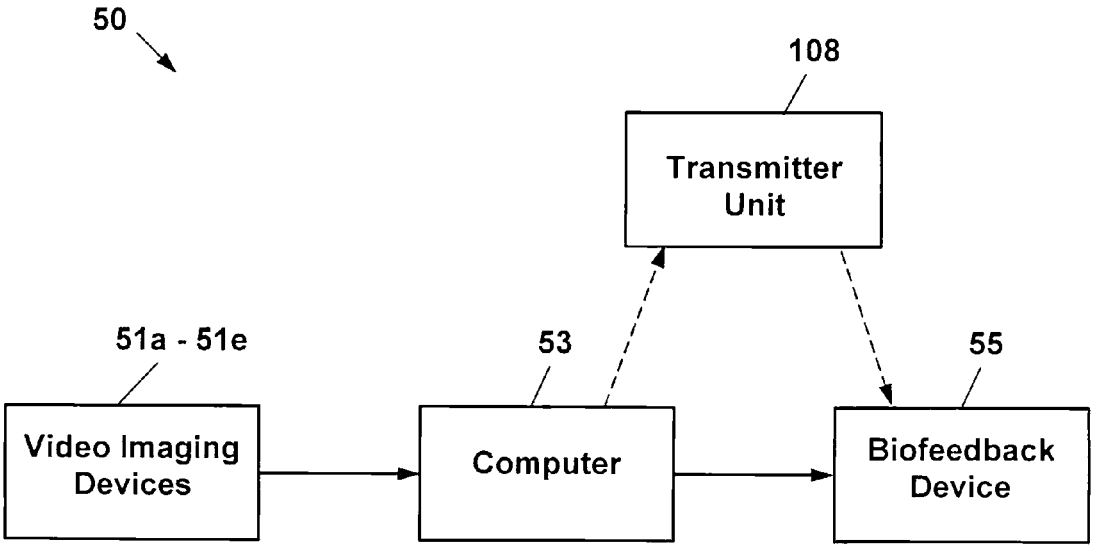

As depicted in FIG. 11A, the swing characteristic data as sensed by the sensors 51 is transferred to the computer 53. The computer 53 may be in a wired relationship with the sensors 51 of the swing trainer 50, or it may be in wireless communication. Alternatively, the computer 53 may be located within the club shaft 64 or other portion of the swinging implement.

Based on the measured acceleration data, the computer 53 preferably calculates the direction of travel of the club shaft 64 in three dimensions. Calculation of the three-dimensional direction and velocity vectors based on the measured acceleration is accomplished using integration routines in software running on the computer 53. One example of a preferred analysis routine is described hereinafter. It should be appreciated that there could be more than three accelerometer assemblies positioned on the shaft, and that the accelerometer assemblies A1, A2 and A3 and any additional accelerometer assemblies can be positioned in various different locations on or within the shaft 64. The depiction of the locations of these assemblies in FIG. 10 is one example of three possible locations.

Figure 12:
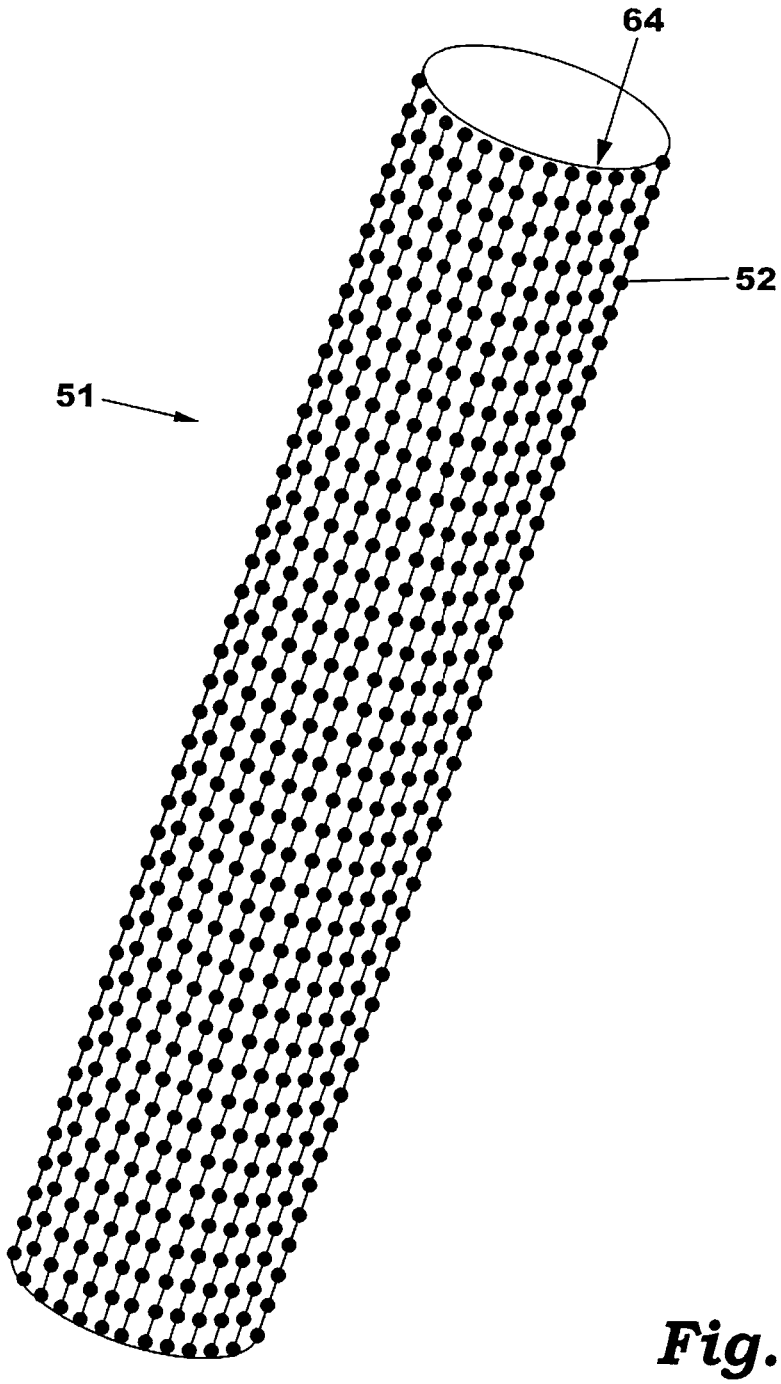
FIG. 12 is a perspective view of a portion of a club shaft of a swing trainer according to an alternative embodiment of the invention showing a plurality of air pressure sensors.

In one embodiment depicted in FIG. 12, the swing characteristic sensors 51 comprise a plurality of air pressure sensors 52 spaced evenly about the circumference of the club shaft 64. Preferably, a plurality of rows of air pressure sensors 52 are located around the circumference of the club shaft 64 or, in the alternative, a single row may be located around the circumference. The air pressure sensors 52 detect the strength of the force of an air vector on the club shaft 64 when a golfer 30 swings the swing trainer 50. During the swing, the air pressure sensors 52 located on the portion of the club shaft 64 aligned with the direction of a swing should detect the greatest air pressure. Thus, the air pressure sensors 52 detecting the largest air pressure generally indicate the direction of the club shaft during the swing and, therefore, the club shaft plane. Based on the strength of the air force vectors on the air pressure sensors 52, the computer 53 can determine the club shaft plane 42 of a golfer's entire swing. This club shaft plane information may then be compared to other information, such as the club face plane or an ideal club shaft plane. Information for these other planes can be obtained by using the accelerometer method or other swing characteristic sensors in combination with the air pressure sensors.

Figure 13:
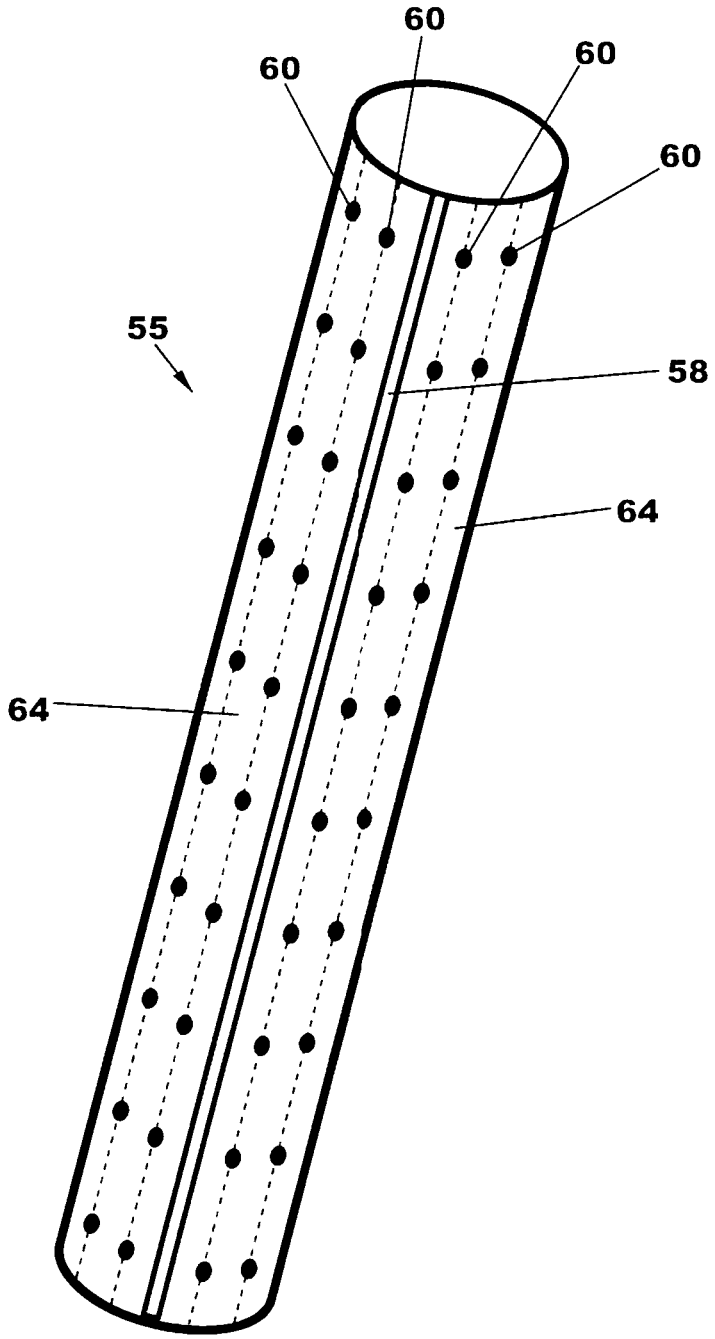
FIG. 13 is a perspective view of a portion of a club shaft of a swing trainer according to a alternative embodiment of the invention showing a plurality of light emitting devices.

As shown in FIG. 13, one embodiment of the swing trainer 50 includes biofeedback devices 55 that communicate biofeedback to the golfer relating to the position of the club face plane and the club shaft plane during the swing. Preferably, the biofeedback includes visual data provided to the golfer. As shown in FIG. 13, the biofeedback devices 55 of this embodiment comprise a plurality of columns of light emitting devices 58 and 60 located around the circumference of the club shaft 64. Preferably, the light emitting devices 58 and 60 are lasers. However, the light emitting devices may be any suitable linear or planar light emitting devices, such as LEDs, FOLEDs, or other suitable light sources. In one embodiment, the position of each of the columns of light emitting devices corresponds to the position of at least one of the swing characteristic sensors 51.

Two of the columns of light emitting devices 58 on the club shaft 64 are preferably oriented in the club face plane on the front and back of the club shaft 180 degrees apart from each other. In alternative embodiments, light emitting devices in the club face plane may also be located on the distal and proximal club heads 66*a* and 66*b* or on a strip of material encircling the club heads in the club face plane. In a preferred embodiment, the light emitting devices 58 in the club face plane are activated during the entire swing.

The other columns of light emitting devices are club shaft plane light emitting devices 60. The club shaft plane light emitting devices 60 are grouped together in pairs 180 degrees apart from each other. During the swing, the pair of club shaft plane light emitting devices 60 located in the closest proximity to the club shaft plane, as determined by the swing characteristic sensors 51 and computer 53, are activated. If the club shaft plane is merged with the club face plane, only the club face plane light emitting devices 58 are turned on. In one embodiment, additional light emitting devices may be turned on when the two planes are merged creating a more intense visual display.

In a preferred embodiment, the club shaft plane light emitting devices 60 emit a different colored light than the club face plane light emitting devices 58. The differing colors allow the golfer to more easily differentiate the two planes. In one embodiment, when the two planes are merged a third color may be emitted giving notice to the golfer of proper two plane merger. Any combination of these light emitting devices can be used with any combination of the previously described swing characteristic sensors to produce a variety of sensing/feedback devices.

Figure 14:
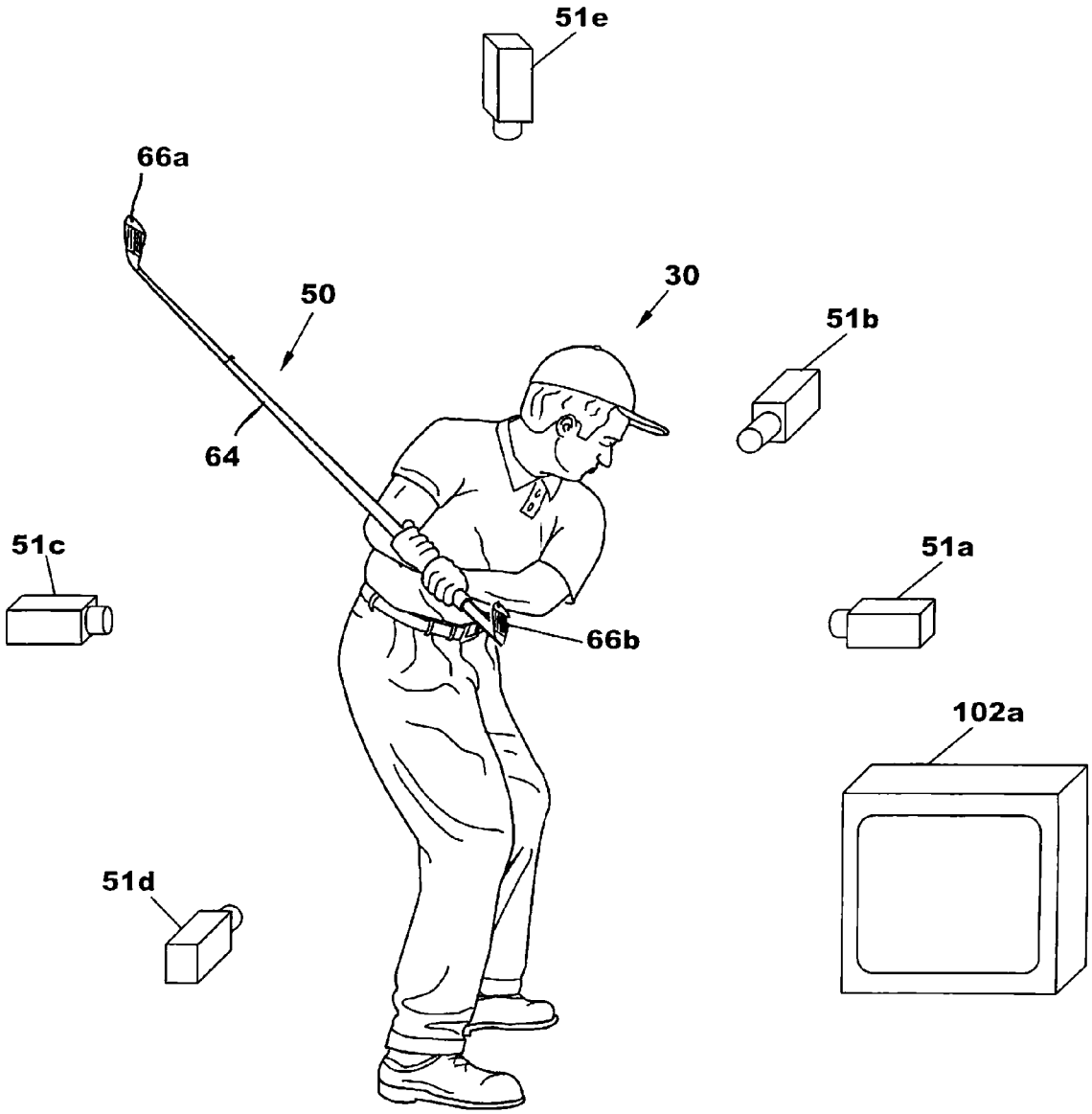
FIGS. 14 and 15 are perspective views showing a golfer executing a swing using a swing training implement while viewing swing characteristics displayed on two alternative embodiments of a video display device.

By viewing the relationship between the club face plane light emitting devices 58, the club shaft plane light emitting devices 60, and empirically generated ideal club shaft plane images, the golfer can make corrections to his swing to generate better two plane merger and a better swing plane, with the ultimate goal of attaining the motion represented by the central probability squares of FIGS. 2A and 2B. Thus, in a preferred embodiment depicted in FIG. 11B, the swing characteristic sensor 51 comprises one or more video cameras and the biofeedback device 55 (FIG. 11B) comprises a video display device to view the swing. As shown in the embodiment of FIG. 14, five video cameras 51*a*-51*e* may be used to capture the swing from five different viewing perspectives. Using the display device, such as the video monitor 102*a*, the golfer 30 may view the planar relationships by viewing a live video representation or a replay of the swing. In preferred embodiments, the video display device comprises a video screen, such as a television or computer screen, a projector, video goggles, or any other suitable display.

As shown in FIG. 15, an embodiment wherein the video display device comprises video goggles 102*b* allows the golfer 30 to swing the training implement 50 while simultaneously viewing the swing in the goggles 102*b* without moving his head out of the correct position for a proper swing. Viewing a recorded video allows a golfer to slow down the replay to more closely study and review the swing and the relationship of the actual planes to the ideal planes. These images from the golfer's swing can also be compared to images of the actual planes of various professional golfers' swings by superimposing the golfer's images and the professional's images on the video display device. The comparison can also be made in a split screen format on the video display device.

In one alternative embodiment, one or more video cameras record the swing of the training implement 50 and the computer 53 uses swing characteristic sensor data from sensors located on the training implement to generate video effects representing the actual club face plane and the actual club shaft plane. The video effects are preferably superimposed on the swing video images for display on a display device. In this manner, the relationship of the actual planes to the ideal planes can be studied without light emitting devices located on the training implement.

The golfer 30 may receive biofeedback other than visual data from the training device 50, such as physical and aural feedback. The golfer may receive aural or physical biofeedback in conjunction with visual feedback or independently of visual feedback. The aural or physical biofeedback may be real time bracketing biofeedback, wherein different signals are provided to a golfer for differing ranges of deviation from a desired range of movement. The desired ranges of movement are predetermined in an empirical fashion by the teaching professional for various aspects of the swing including, but not limited to, the relationship of the club face plane to the club shaft plane, the relationship of the club shaft plane to an ideal club shaft plane, the arc of the swing, and the tempo of the swing.

In one embodiment, such as depicted in FIG. 15, the biofeedback device 55 includes headphones 104 worn by the golfer while using the swing trainer 50. While isolating training to the segments of the backswing and downswing between nine o'clock and three o'clock toe down, the golfer does not hear any audible signals in the headphones 104 when the club face plane is correctly positioned with respect to the club shaft plane. However, when the club face plane is over-rotated in relation to the club shaft plane an audible signal at a first pitch is delivered to the golfer from the headphones 104. If the club face plane is under-rotated in relation to the club shaft plane, an audible signal at a second pitch is delivered to the golfer from the headphones 104. The volume of the audible signals increases as the degree of over-rotation or under-rotation increases. Similar audible signals can be used to alert the golfer to behind-the plane and front-of-the-plane errors. These audible signals are delivered in real time, allowing a golfer to immediately comprehend the errors occurring during a golf swing. Similar audible signals may also be provided while isolating training to the impact area of the downswing (nine o'clock through three o'clock toe up) or to the takeaway area of the backswing (six o'clock to nine o'clock). Alternatively, all segments of the swing can be studied simultaneously with a wide range of bracketing biofeedback audible signals. In alternative embodiments, audio speakers located in close proximity to the golfer may be used in place of headphones.

In some embodiments, the biofeedback device 55 (FIGS. 11A and 11B) provides to the golfer physical biofeedback, such as vibrations. For example, in the embodiment depicted in FIG. 16, the biofeedback device includes vibrator pads 106*a*, 106*b* strapped to the forearms of the golfer 30. The vibrator pads 106*a*, 106*b* preferably incorporate vibrator units such as those used in cellular telephones for providing a vibration ring option. As errors occur in the golfer's swing, the vibrator pads 106*a*, 106*b* are selectively activated by signals from the computer 53 (FIGS. 11A and 11B) to indicate to the golfer that correction is needed. For example, in the case of an under-rotation error, the pad 106*a* may be activated, and in the case of an over-rotation error, the pad 106*b* may be activated. As the degree of the error increases, the vibrations may increase in amplitude or frequency. Similarly, the pads 106*a*, 106*b* may be used to indicate behind-the-plane and front-of-the-plane errors.

Figure 16:
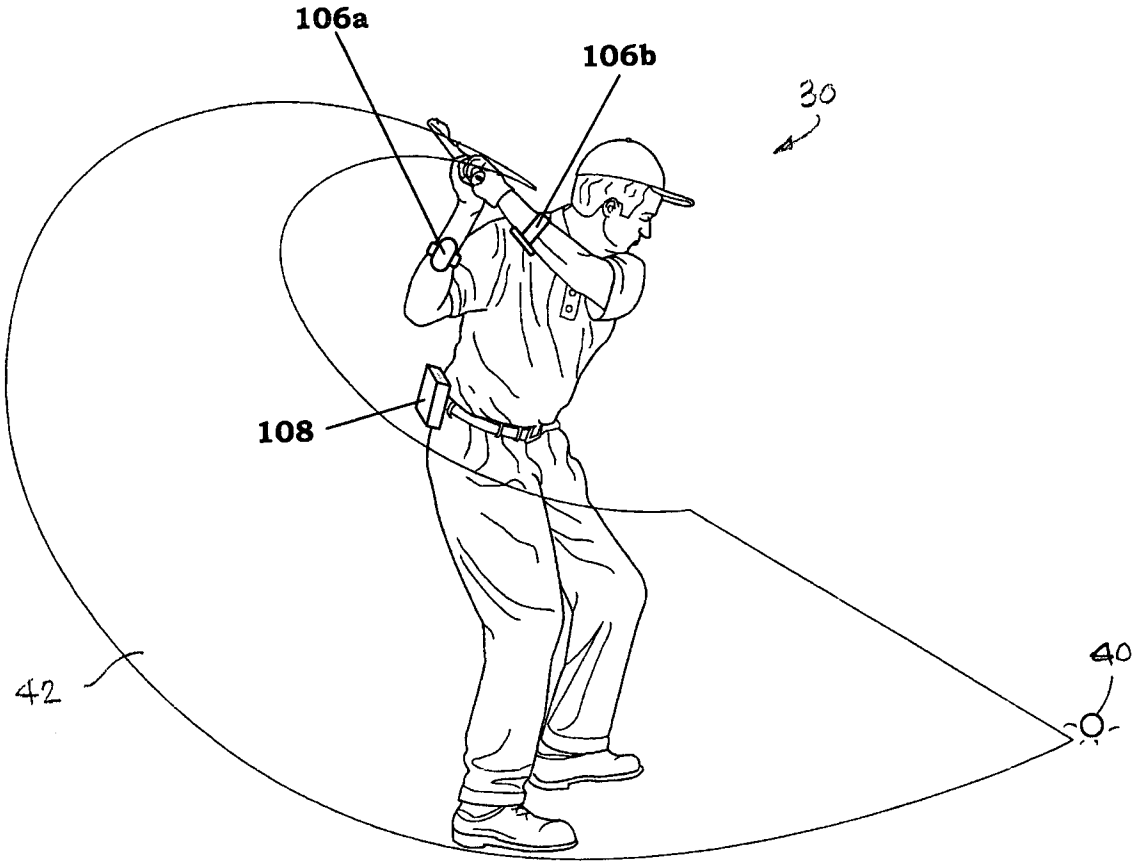
FIG. 16 is a perspective view showing a golfer executing a swing using a swing training implement while receiving biofeedback from tactile biofeedback devices attached to the golfer's forearms.

Preferably, the vibrator pads 106*a*, 106*b* are activated via wireless signals, such as using Bluetooth or similar wireless communication protocols. In one embodiment, such signals are transmitted from a transmitter unit 108 attached to the golfer's belt as shown in FIG. 16. Alternatively, the transmitter unit 108 may be embodied in a wireless transmission device incorporated into a computer board or chipset of the computer 53 (FIGS. 11A and 11B). In other embodiments, the vibrator pads 106*a*, 106*b* are activated via signals provided by wires running between the pads 106*a*, 106*b* and the transmitter unit 108 or wires from the computer 53.

Physical biofeedback may also be provided by way of vibrations in the shaft or grip of the training implement. In some embodiments, the vibrations are applied at different frequencies to indicate different errors, such as under-rotation, over-rotation, behind-the-plane, and front-of-the-plane.

Additional modes of biofeedback can be generated using the swing error probability diagrams of FIGS. 2A and 2B. For example, using audio biofeedback, the eight error states of each diagram may be represented by eight different sounds in headphones 104 worn by the golfer while swinging the implement. (See FIG. 15.) Visual biofeedback may be provided, for example, by displaying a graphic representation of the matrix shown in FIGS. 2A and 2B on the video screen 102*a* or in video goggles 102*b*. (See FIGS. 14 and 15.) The state of error at the corresponding point during the swing of the implement 50 may be indicated on the display by highlighting the corresponding portion of the matrix, either in real-time or as part of a later analysis of the swing data.

By using the above described swing trainer 50, golfers may improve their swing toward the ideal two-plane merger swing represented by the central probability squares shown in FIGS. 2A and 2B. Through the biofeedback methods and devices described herein, the swing trainer 50 provides information to a golfer regarding the relationships of the club face plane to the actual club shaft plane and the actual club shaft plane to the ideal club shaft plane during the swing. From this information, a golfer may make changes to his swing and receive substantially instantaneous feedback concerning problem areas in the swing. The swing trainer 50 may be used to isolate specific portions of the swing or to pinpoint the areas of the swing that are causing problems.

Figure 17:
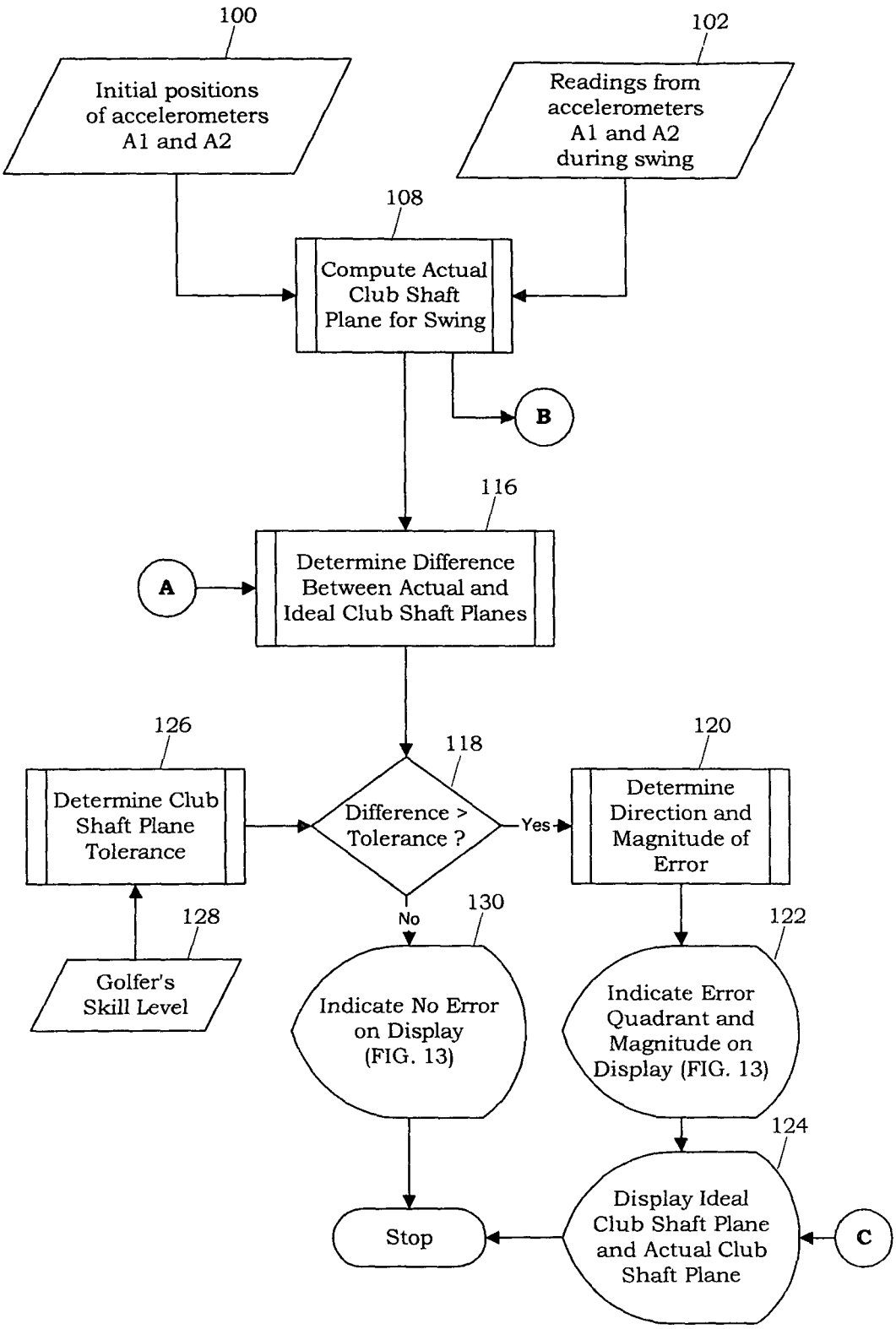
FIG. 17 depicts a flowchart of a method for comparing an actual club shaft plane to an ideal club shaft plane according to a preferred embodiment of the invention.

As set forth previously, the swing characteristic sensors 51 (FIG. 11A) may comprise accelerometer units A1, A2 and A3 attached to the shaft 64 and head 66*a* of the swing training implement (FIG. 10). In a preferred embodiment of the invention, acceleration signals from the units A1, A2 and A3 are provided to a data acquisition board of a computer 53 where the acceleration signals are conditioned and digitized. As shown in FIG. 17, the initial positions of accelerometers A1 and A2 are determined at the beginning of a swing (step 100), such as by precise placement of the club head and shaft at predetermined reference positions. The implement 50 is then swung while sampling the accelerometer signals at about one millisecond intervals (step 102). The sampled acceleration data is provided to a numerical ordinary differential equation (ODE) solver running on the computer 53. The ODE solver may be implemented as a commercially available software routine designed for acceleration-to-position conversions or as a more generally applicable Computer Algebraic System (CAS), such as Mathematica™. Preferably, the solver routine applies a Runge-Kutta method or other equivalent method suited for this purpose.

The ODE solver calculates the positions of the accelerometers A1 and A2 independently based on the data points measured at each sample interval (step 108). These position points, when associated as pairs, indicate the locations of the endpoints of the implement shaft 64 during the swing. Thus, the calculated endpoints of the shaft 64 trace out the actual club shaft plane during the swing of the implement 50.

Because of compounding of errors in the numerical methods applied in computing the actual club shaft plane and errors in the accelerometer data, it is anticipated that computation of the actual club shaft plane of the backswing may be more accurate than that of the actual club shaft plane of the downswing and the actual club shaft plane of the follow-through. With this consideration, one preferred embodiment of the invention calculates the actual club shaft plane for the backswing only, and another preferred embodiment calculates the actual club shaft plane for the backswing, downswing, and follow-through.

In either case, the end of the backswing must be determined so that the computation of the backswing may be separable from the computation of the downswing. In one embodiment, the end of the backswing is determined to have been reached when the horizontal separation between the computed positions of the accelerometer A2 (at the heel of the club head) and the accelerometer A1 (at the end of the grip) is greater than some predetermined amount Although of different polarity, this value would also reach a maximum at the nine o'clock position. In an alternative embodiment, the end of the backswing is determined to have been reached when the vertical position of the accelerometer A1 (at the end of the grip) in relation to the ground ceases to increase and begins to decrease.

Table I below provides a nomenclature for referring to the various segments of a swing.

TABLE I

| Segment No. | Swing Segment Name | Clock Position | Relative Vertical Positions of Accelerometers A1 and A2 |
|---|---|---|---|
| 1 | Address | 6 o'clock | vA2 ≈ zero[1]<br>vA1 − vA2 at positive maximum[2] |
| 2 | Take-away | 6 o'clock-9 o'clock (toe up) | vA1 − vA2 positive and decreasing |
| 3 | Backswing horizontal | 9 o'clock (toe up) | vA1 ≈ vA2 |
| 4 | Initial hinging | 9 o'clock-12 o'clock | vA1 − vA2 negative and increasing |
| 5 | Backswing vertical | 12 o'clock | vA1 − vA2 at negative maximum |
| 6 | Finish hinging | 12 o'clock-3 o'clock (toe down) | vA1 − vA2 negative and decreasing |
| 7 | Backswing completion | 3 o'clock (toe down) | vA1 ≈ vA2<br>Near this point, motions of A1 and A2 experience pauses of variable duration. The duration of pause for A1 and A2 will be different due to bending of the club shaft that occurs when A1 stops moving. Three o'clock toe down is a generalization, as this club shaft position in a full stroke |

TABLE I-continued

| Segment No. | Swing Segment Name | Clock Position | Relative Vertical Positions of Accelerometers A1 and A2 |
|---|---|---|---|
| | | | will vary for different golfers and for different clubs swung by the same golfer. |
| 8 | Downswing initiation | 3 o'clock-12 o'clock (toe down) | vA1 − vA2 negative and increasing<br>Maintenance of the wrist hinge is crucial until the Downswing Release segment. A stable wrist hinge results in a minimal increase in vA2 in the early part of this segment. An improper early release of the wrist hinge position "casting move" will result in an exaggerated increase in vA2 during the early part of this segment. |
| 9 | Downswing vertical | 12 o'clock | vA1 − vA2 at negative maximum<br>Flattening of ideal downswing club shaft plane means that the difference between vA2 and vA1 will be less than it was for Backswing Vertical segment. |
| 10 | Downswing middle | 12 o'clock-9 o'clock (toe up) | vA1 − vA2 negative and decreasing |
| 11 | Downswing horizontal | 9 o'clock (toe up) | vA1 ≈ vA2 |
| 12 | Downswing release | 9 o'clock-6 o'clock | vA1 − vA2 positive and increasing |
| 13 | Impact | 6 o'clock | vA2 ≈ zero<br>vA1 − vA2 at positive maximum<br>Flattening of ideal downswing club shaft plane means that the difference between vA2 and vA1 will be less than it was at Address segment. |
| 14 | Impact follow-through | 6 o'clock-3 o'clock (toe up) | vA1 − vA2 positive and decreasing |
| 15 | Follow-through horizontal | 3 o'clock | vA1 ≈ vA2 |
| 16 | Re-hinging | 3 o'clock-12 o'clock (toe up) | vA1 − vA2 negative and increasing |
| 17 | Follow-through vertical | 12 o'clock | vA1 − vA2 at negative maximum |
| 18 | Finish re-hinging | 12 o'clock-9 o'clock (toe down) | vA2 − vA1 positive and decreasing |
| 19 | Follow-through completion | 9 o'clock (toe down) | vA1 ≈ vA2 |

[1]vA2 is the vertical position of accelerometer A2 with respect to the ground.
[2]vA1 is the vertical position of accelerometer A1 with respect to the ground.

Figure 19:
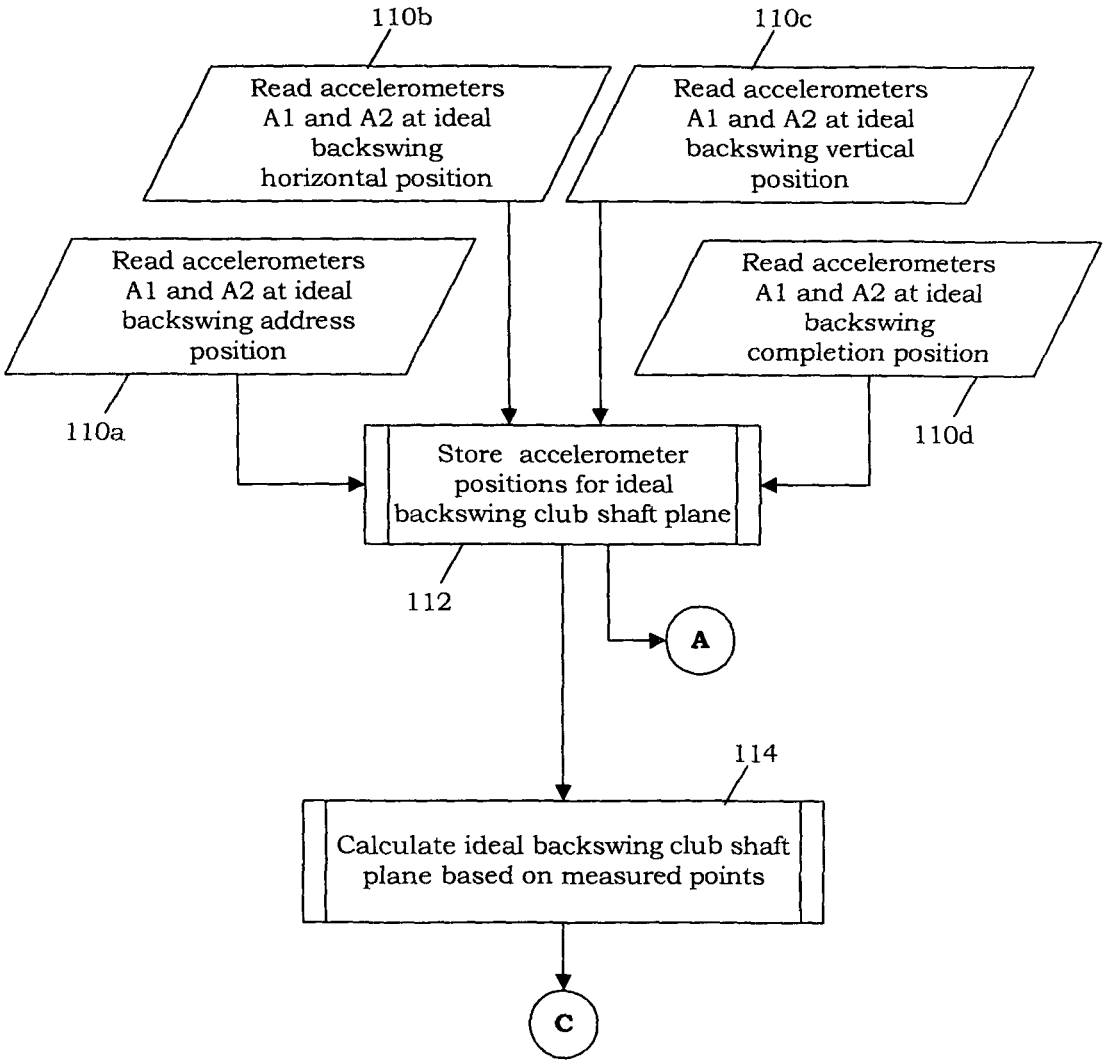
FIG. 19 depicts a flowchart of a method for determining an ideal backswing club shaft plane according to a preferred embodiment of the invention.
Figure 20:
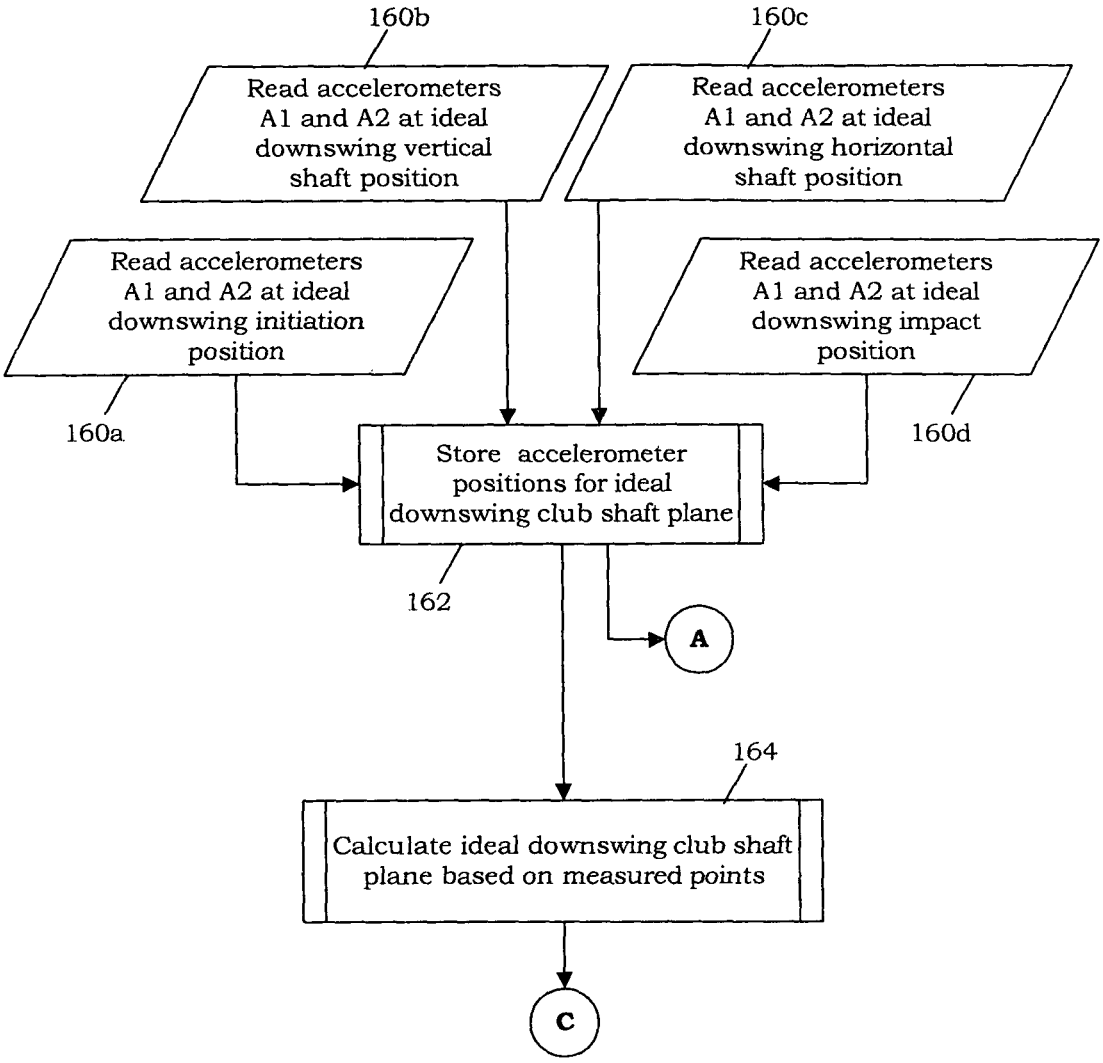
FIG. 20 depicts a flowchart of a method for determining an ideal downswing club shaft plane according to a preferred embodiment of the invention.
Figure 21:
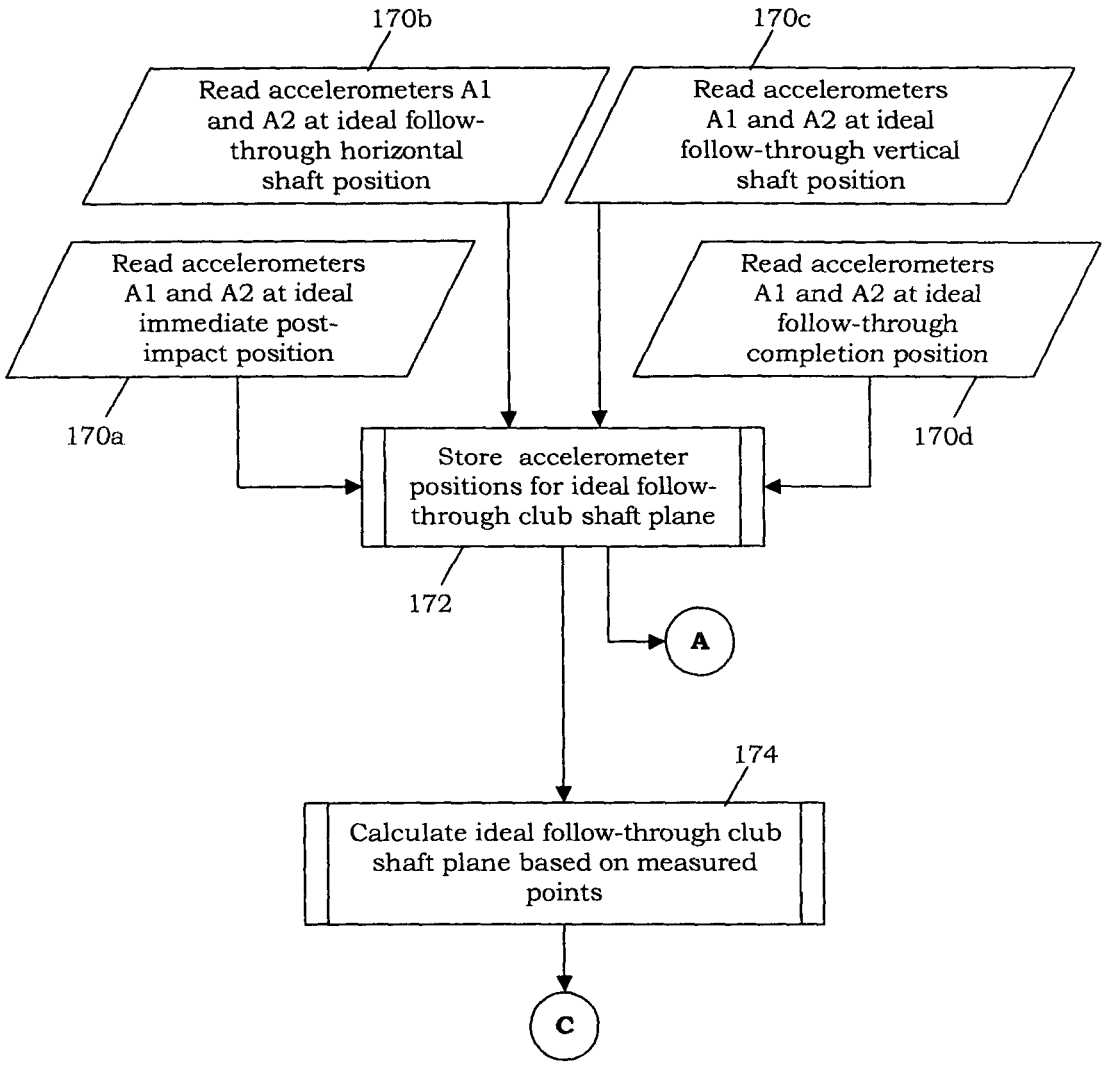
FIG. 21 depicts a flowchart of a method for determining an ideal follow-through club shaft plane according to a preferred embodiment of the invention.

In the preferred embodiment of the invention, the ideal club shaft plane for the three main segments of a swing, referred to herein as the backswing, downswing, and follow-through, is determined according to the method depicted in FIGS. 19, 20, and 21. Each individual golfer has many unique physical characteristics that can affect the orientation of the golfer's ideal club shaft planes, such as height, body proportions, weight, flexibility, etc. Thus, to determine discrete points that lie in the golfer's ideal club shaft planes, it is preferred that a trained professional help the golfer to position the golf club to those positions. Using the accelerometer sensors A1 and A2, the coordinates of the end points of the club are sensed at each of the discrete positions in the ideal club shaft plane for each of the three main segments.

For the backswing (FIG. 19), these "ideal" discrete points are determined at the address position (segment 1), the backswing horizontal position (segment 3), the backswing vertical position (segment 5) and the backswing completion position (segment 7). With the club shaft representing the hand of a clock, the address position of the club is at about the six-o'clock position, corresponding to the position at which the golfer addresses the golf ball. The backswing horizontal position of the club is at the nine o'clock position in the backswing of a right-handed golfer (from the perspective of a person facing the golfer). The backswing vertical position of the club is at the twelve o'clock position in the backswing. The backswing completion position corresponds to about the three o'clock toe down position in the backswing of a right-handed golfer (again from the perspective of a person facing the golfer). For a left-handed golfer, the backswing horizontal position is three o'clock toe up and the backswing completion position is nine o'clock toe down.

Thus, according to the preferred embodiment depicted in FIG. 19, the professional places the golfer and club in, at least, these four positions in the golfer's ideal backswing club shaft plane and the signals from the accelerometers A1 and A2 are read while the club is held stationary at each position (steps 111*a*, 110*b*, 110*c*, 110*d*). More ideal positions can be stored if desired. Each of these positions is stored in memory of the computer 53 (FIG. 11A; step 112 in FIG. 19) and is used in calculating an entire ideal club shaft plane (step 114). In the preferred embodiment, the calculation of the ideal club shaft plane is based on interpolating between the four or more measured points at each end of the club using a three-dimensional curve-fitting routine.

Preferably, the same method is used for the downswing and follow-through as depicted in FIGS. 20 and 21 respectively. Once again, only four positions each are represented for the downswing and follow-through, but more positions can be entered if desired.

At step 116 in FIG. 17, at least the four discrete positions of the club for each of the three main segments determined during an actual swing (sensed at step 102) are then compared to at least the four ideal club shaft plane positions for each main segment (sensed at steps 110*a*-110*d*, 160*a*-160*d*, and 170*a*-170*d*). If the difference between any of the club shaft positions sensed at step 102 and the corresponding club shaft positions sensed at steps 110*a*-110*d*, 160*a*-160*d*, and 170*a*-170*d* is greater than a predetermined shaft plane tolerance (step 118), then an error condition (behind or in front of the ideal club shaft plane) is indicated (step 120). In the preferred embodiment, the error condition may be represented on an error matrix, such as depicted in FIG. 2A or FIG. 2B, displayed on a display device (such as the video monitor 102*a* of FIG. 14) (step 122). Graphical representations of the ideal and actual club shaft planes may also be displayed on the display device (step 124). Instantaneous biofeedback may also be provided to the trainee in aural, physical, and/or alternative visual modes (step 121).

Preferably, determination of the shaft plane tolerance (step 126) is based at least in part on inputting the level of skill of the golfer (step 128), i.e., beginner, intermediate or advanced. This allows players of any caliber to benefit from the use of the system 50. In the preferred embodiment, the shaft plane tolerance is not set less than a value equal to twice the standard error as determined by the combined accuracy of the accelerometers and the numerical method applied at step 108. The standard error may be determined by repetitive calculation of the actual club shaft plane as the implement 50 is repetitively swung through a highly repeatable path using a mechanical swinging device.

If the difference between each of the club shaft positions sensed at step 102 and the corresponding club shaft position sensed at steps 110*a*-110*d*, 160*a*-160*d* and 170*a*-170*d* is less than or equal to the shaft plane tolerance (step 118), then no error condition is indicated (step 130). In the preferred embodiment, the no-error condition is indicated only if the comparison at all positions is within the tolerance. Preferably, the no-error condition is indicated by highlighting one of the blocks (I/O, I/M or I/U) in FIG. 2A. (step 130).

Figure 18:
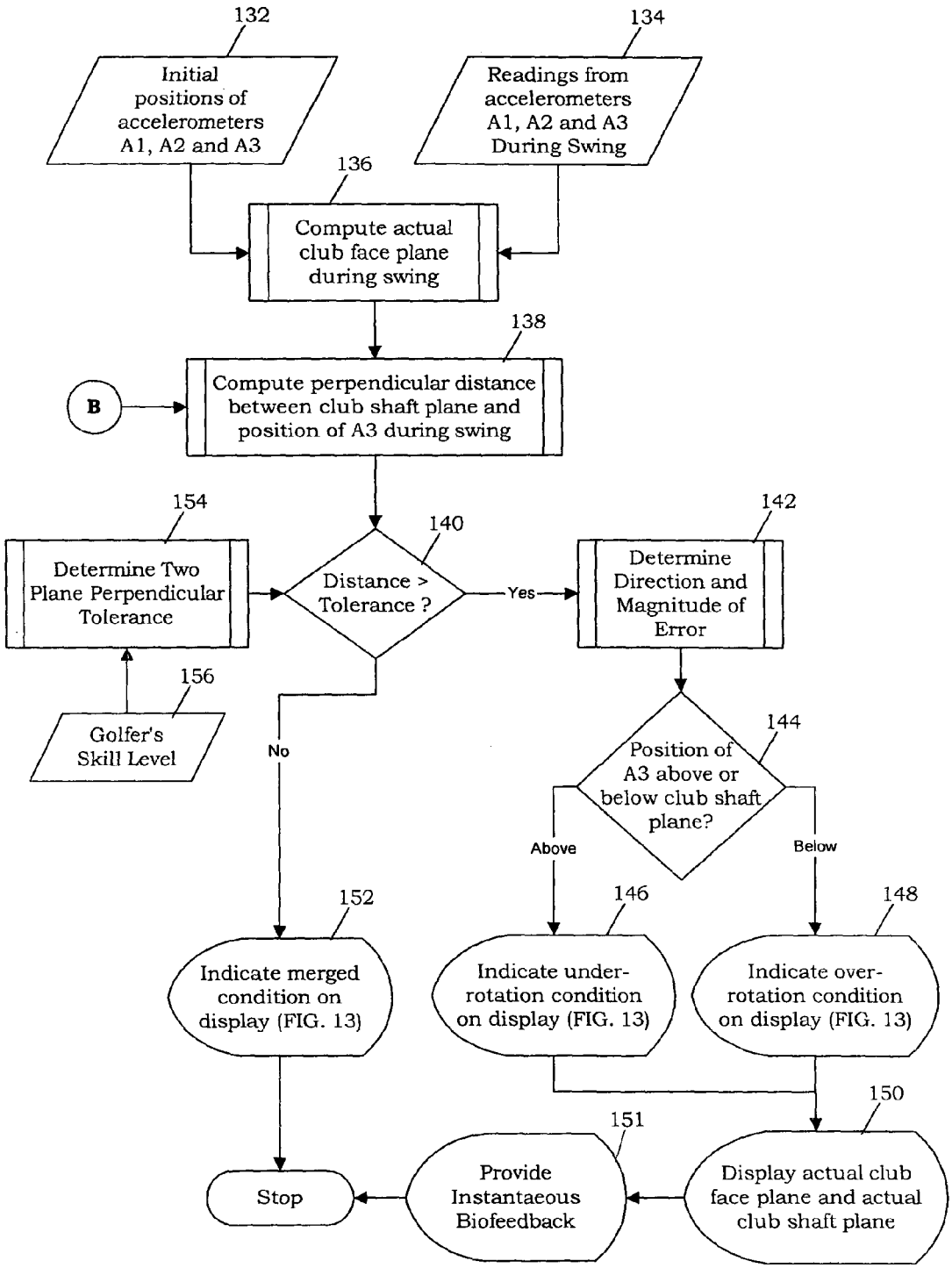
FIG. 18 depicts a flowchart of a method for determining a relationship between a club shaft plane and a club face plane during a swing of a swing training implement according to a preferred embodiment of the invention.

Calculation of the club face plane proceeds as depicted in FIG. 18. As discussed previously, the club face plane is a true plane representing the position of the club face as if the club face had zero degrees of loft. The club face plane can be envisioned as an extension of a zero-degree club face that also passes through the shaft of the club. At the address position of the club, the club face plane is ideally a vertical plane that is essentially perpendicular to the club shaft plane.

As shown in FIG. 18, the initial positions of accelerometers A1, A2 and A3 are determined at the beginning of the swing (step 132) with the club head and shaft positioned at predetermined reference positions. As the implement 50 is swung, the accelerometer signals from A1, A2 and A3 are sampled at about one millisecond intervals (step 134). The sampled acceleration data is provided to the numerical ordinary differential equation (ODE) solver running on the computer 53, which calculates the club face plane based on the positions of the accelerometers A1, A2 and A3 measured at each sample interval (step 136). These three position points at each sample interval define the club face plane during the swing.

In determining the relationship of the club face plane to the actual club shaft plane, the full swing is divided by a horizontal line running through the nine o'clock and three o'clock positions. The half of the swing above the dividing horizontal line includes all segments of the backswing, downswing, and follow-through which occur above the horizontal line (Initial Hinging, Backswing Vertical, Finish Hinging, Backswing Completion, Downswing Initiation, Downswing Vertical, Downswing Middle, Re-Hinging, Follow-Through Vertical, Finish Re-Hinging, and Follow-Through Completion) and is referred to as the two plane merger zone of the swing. Motion errors within the two plane merger zone of the swing are represented by the probability diagram in FIG. 2A. The other zone of the swing which exists below the dividing horizontal line includes all segments of the backswing, downswing, and follow-through which occur below the horizontal line (Address, Take-Away, Downswing Release, Impact, and Impact Follow-Through) and is referred to as the two plane perpendicular zone or impact zone of the swing. Motion errors within the two plane perpendicular zone of the swing are represented by the probability diagram in FIG. 2B.

In the preferred embodiment of the invention, whether the club face plane merges with club shaft plane during the two plane merger zone of the swing is determined based on the perpendicular distance between the club shaft plane and the position of the accelerometer A3 (step 138). When this perpendicular distance is within a predetermined tolerance range, the club face plane is said to be merged with the club shaft plane. Preferably, this tolerance value, also referred to as the plane merger tolerance, is determined based on data representing the level of skill of the golfer who is using the training device (steps 154 and 156). For example, the plane merger tolerance for a skilled golfer may be one quarter inch or less, whereas for a beginner it may be one inch.

If the perpendicular distance between the club shaft plane and the position of the accelerometer A3 is greater than the plane merger tolerance (step 140), then the direction and magnitude of the demerger error is determined (step 142). If the position of the accelerometer A3 is above the club shaft plane (step 144), an under-rotation condition is indicated (step 146). In embodiments of the invention incorporating a video display as part of the biofeedback device 55 (FIG. 11A), the under-rotation error may be indicated by highlighting one of the blocks (B/U, I/U, or F/U) in FIG. 2A. If the position of the accelerometer A3 is below the club shaft plane (step 144), an over-rotation condition is indicated (step 148), such as by highlighting one of the blocks (B/O, I/O, or F/O) in FIG. 2A. In some preferred embodiments, a graphic display showing the relative positions of the club face plane and the club shaft plane during the two plane merger half of the swing is also provided on a display device (step 150). Instantaneous biofeedback may also be provided to the trainee in aural, physical, and/or alternative visual modes (step 151).

If the perpendicular distance between the club shaft plane and the position of the accelerometer A3 less than or equal to the plane merger tolerance (step 140), then a merged condition is indicated, such as by highlighting one of the blocks (B/M, I/M, or F/M) in FIG. 2A (step 152).

In the preferred embodiment of the invention, whether the club face plane is perpendicular to the club shaft plane at impact is also determined based on the perpendicular distance between the club shaft plane and the position of accelerometer A3 (step 138). When this perpendicular distance at impact is within a predetermined tolerance range, the club face plane is said to be square at impact (indicated by the "+" in FIG. 2B). Preferably, this tolerance value, also referred to as the two-plane perpendicular tolerance, is determined based on data representing the level of skill of the golfer who is using the training device (steps 154 and 156). For example, the two-plane perpendicular tolerance for a skilled golfer may be one eighth inch or less, whereas for a beginner it may be one half inch.

If the distance from a perpendicular relationship between the club face plane and the club shaft plane at impact is greater than the two plane perpendicular tolerance (step 140), then the direction and magnitude of the impact error is determined (step 142). If the position of the accelerometer A3 falls short of being perpendicular at impact (step 144), a slice club face plane condition is indicated (step 148). In embodiments of the invention incorporating a video display as part of the biofeedback device 55 (FIG. 11A), the slice error may be indicated by highlighting one of the blocks EIO/S, IIO/S, or EOI/S in FIG. 2B. If the position of the accelerometer A3 goes beyond being perpendicular at impact (step 144), a hook club face plane condition is indicated (step 146), such as by highlighting one of the blocks EIO/H, IIO/H, or EOI/H in FIG. 2B. In some preferred embodiments, a graphic display showing the relative positions of the club face plane and the club shaft plane during the two plane perpendicular zone of the swing is also provided on a display device (step 150). Instantaneous biofeedback may also be provided to the trainee in aural, physical, and/or alternative visual modes (step 151).

If the distance form a perpendicular relationship between the club face plane and the club shaft plane at impact is less than or equal to the two-plane perpendicular tolerance (step 140), then a square club face plane condition is indicated, such as by highlighting one of the blocks EIO/+, 110/+, or EOI/+ in FIG. 2B (step 152).

The game of golf, and particularly the backswing and downswing of a golf club in playing the game of golf, has been used herein as an example to describe the principles of the invention covered herein, as practiced by the use of the various embodiments and versions of the above-described motion trainer 50 and training method. However, the motion trainer 50 and training methods described above can also be associated with other sports games and activities. For example, games such as baseball, softball, tennis, and racket ball utilize swings which may be improved by use of the above apparatus.

The foregoing description of preferred embodiments for this invention has been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. A motion trainer for improving a person's movement of an implement along a desired path, the motion trainer comprising:

an implement for the person to move;

at least one video camera for capturing video images of the person moving the implement;

at least one motion characteristic sensor disposed on the implement for generating motion characteristic signals indicative of positions of an implement face plane and an implement shaft plane during the movement of the implement by the person, the implement face plane comprising a plane having substantially zero degree of loft, which plane intersects the implement face but which is independent of the actual loft of the implement face, the implement shaft plane comprising a plane coinciding with the implement shaft and coinciding with the direction of travel of the implement shaft during the movement;

a computing device for receiving the motion characteristic signals and for generating biofeedback information signals comprising video representations of the implement face plane and the implement shaft plane of the implement; and a video display device for simultaneously displaying the video images from the video camera and the video representations of the implement face plane and implement shaft plane.

2. The motion trainer of claim 1 wherein the implement is selected from the group consisting of a golf club, a baseball bat, a softball bat, a tennis racket, a racquetball racket, an axe, a hammer and a maul.

3. A motion trainer for improving a person's movement of an implement along a desired path, the motion trainer comprising:

an implement for the person to move;

at least one accelerometer disposed on the implement for generating accelerometer signals related to characteristics of the implement during the movement;

a computing device for receiving the accelerometer signals and for generating biofeedback information based on the accelerometer signals, wherein the biofeedback information indicates an orientation of an implement face plane relative to an implement shaft plane during the movement of the implement, the implement face plane comprising a plane having substantially zero degree of loft, which plane intersects the implement face but which is independent of the actual loft of the implement face, the implement shaft plane comprising a plane coinciding with the implement shaft and coinciding with the direction of travel of the implement shaft during the movement;

at least one light emitting device disposed on the implement and coupled to the computing device for emitting light having light characteristics that are determined by the orientation of the implement face plane relative to the implement shaft plane during the movement of the implement; and a video display device for providing a visual representation of the movement based at least in part on the light characteristics of the light emitted from the at least one light emitting device.

4. The motion trainer of claim 3 wherein the implement is selected from the group consisting of a golf club, a baseball bat, a softball bat, a tennis racket, a racquetball racket, an axe, a hammer and a maul.

5. A golf club swing training apparatus for providing biofeedback regarding errors in positioning of a club face plane in relation to a club shaft plane of a golf club as a person swings a swing training implement, the swing training apparatus comprising:

the implement for the person to swing;

at least one swing characteristic sensing device disposed on the implement for generating swing characteristic signals related to characteristics of the implement during the swing;

a computing device for receiving the swing characteristic signals and for generating biofeedback information signals during the swing based on the swing characteristic signals; and at least one biofeedback device for receiving the biofeedback information signals from the computing device and for providing biofeedback information based on the biofeedback information signals, where the biofeedback information includes information indicating whether the swing exhibits an over-rotation or under-rotation of the club face plane in relation to the club shaft plane, and the biofeedback information is provided to the person during the swing in which the biofeedback information signals are generated, the at least one biofeedback device comprising one or more of a video display device displaying video representations of the club face plane and club shaft plane, audio speakers or audio headphones providing aural biofeedback information, and vibration generating devices providing physical biofeedback information, wherein the club face plane comprises a plane having substantially zero degree of loft, which plane intersects the club face but which is independent of the actual loft of the club face, wherein the club shaft plane comprises a plane coinciding with the club shaft and coinciding with the direction of travel of the club shaft during the swing.

6. The golf club swing training apparatus of claim 5 wherein the at least one biofeedback device provides biofeedback information indicating whether the swing exhibits a behind-the-ideal-club-shaft-plane error or a front-of-the-ideal-club-shaft-plane error.

7. The golf club swing training apparatus of claim 6 wherein the at least one biofeedback device provides biofeedback information indicating whether the swing exhibits one or more swing errors in a two plane merger zone of the swing, the swing errors selected from the group consisting of:

a behind-the-ideal-club-shaft-plane with over-rotation error;

a behind-the-ideal-club-shaft-plane with under-rotation error;

a behind-the-ideal-club-shaft-plane and merged error;

an in-the-ideal-club-shaft-plane with over-rotation error;

an in-the-ideal-club-shaft-plane with under-rotation error;

a front-of-the-ideal-club-shaft-plane with over-rotation error;

a front-of-the-ideal-club-shaft-plane with under-rotation error; and a front-of-the-ideal-club-shaft-plane and merged error.

8. The golf club swing training apparatus of claim 6 wherein the at least one biofeedback device provides information indicating an ideal swing which exhibits an ideal in-the-ideal-club-shaft-plane with merged condition in a two plane merger zone of the swing.

9. The golf club swing training apparatus of claim 5 wherein the at least one swing characteristic sensing device further comprises a first accelerometer and a second accelerometer for generating swing characteristic signals indicative of a position of a club shaft plane during the swing, and a third accelerometer for generating a swing characteristic signal indicative of a position of a club face plane relative to the club shaft plane during the swing;

the computing device for receiving the swing characteristic signals from the first, second and third accelerometers, for determining whether the club face plane is substantially perpendicular to the club shaft plane at an impact position of the swing, and for generating the biofeedback information signals to be indicative of whether the club face plane is substantially perpendicular to the club shaft plane at the impact position of the swing; and the at least one biofeedback device for providing information indicating that the swing exhibits an over- rotation or under-rotation of the club face plane in relation to the club shaft plane when the club face plane is not substantially perpendicular to the club shaft plane at the impact position of the swing.

10. The golf club swing training apparatus of claim 9 wherein the at least one biofeedback device provides information indicating that the swing exhibits one or more swing errors at the impact position of the swing, where the swing errors are selected from the group consisting of:

a non-ideal inside-out with hook error;

a non-ideal inside-out with square error;

a non-ideal inside-out with slice error;

an ideal inside-out with hook error;

an ideal inside-out with slice error;

an outside-in with hook error;

an outside-in with square error; and an outside-in with slice error.

11. The golf club swing training apparatus of claim 9 wherein the at least one biofeedback device provides biofeedback information indicating an ideal swing which exhibits an ideal inside-out with square condition at the impact position of the swing.

12. The golf club swing training apparatus of claim 5 wherein the at least one swing characteristic sensing device further comprises a first accelerometer and a second accelerometer for generating swing characteristic signals indicative of a position of a club shaft plane during the swing, and a third accelerometer for generating a swing characteristic signal indicative of a position of a club face plane relative to the club shaft plane during the swing;

the computing device for receiving the swing characteristic signals from the first, second and third accelerometers, for determining whether the club face plane is substantially merged with the club shaft plane in a two plane merger zone of the swing, and for generating the biofeedback information signals to be indicative of whether the club face plane is substantially merged with the club shaft plane in the two plane merger zone of the swing; and the at least one biofeedback device for providing information indicating that the swing exhibits an over- rotation or under-rotation of the club face plane in relation to the club shaft plane when the club face plane is not substantially merged with the club shaft plane in the two plane merger zone of the swing.

13. The golf club swing training apparatus of claim 12 wherein the at least one biofeedback device provides biofeedback information indicating whether the swing exhibits one or more swing errors in the two plane merger zone of the swing, the swing errors selected from the group consisting of:

a behind-the-ideal-club-shaft-plane with over-rotation error;

a behind-the-ideal-club-shaft-plane with under-rotation error;

a behind-the-ideal-club-shaft-plane and merged error;

an in-the-ideal-club-shaft-plane with over-rotation error;

an in-the-ideal-club-shaft-plane with under-rotation error;

a front-of-the-ideal-club-shaft-plane with over-rotation error;

a front-of-the-ideal-club-shaft-plane with under-rotation error; and a front-of-the-ideal-club-shaft-plane and merged error.

14. The apparatus of claim 12 wherein the at least one biofeedback device provides biofeedback information indicating an ideal swing which exhibits an ideal in-the-ideal-club-shaft-plane with merged condition in the two plane merger zone of the swing.

15. The apparatus of claim 5 further comprising:

at least one video camera for capturing video images of the person swinging the implement;

the computing device further for generating the biofeedback information signals comprising video representations of the club face plane and the club shaft plane of the implement; and the at least one biofeedback device further comprising the video display device for simultaneously displaying the video images from the video camera and the video representations of the club face plane and club shaft plane.

16. A method for improving a person's movement of an implement along a desired path, the method comprising:

(a) providing an implement for the person to move, where the implement includes at least one motion characteristic sensor and at least one light emitting device disposed thereon;

(b) generating motion characteristic signals using the motion characteristic sensor, where the motion characteristics are related to characteristics of the implement during the movement;

(c) generating biofeedback information signals based on the motion characteristic signals, wherein the biofeedback information signals indicate an orientation of an implement face plane relative to an implement shaft plane during the movement of the implement, the implement face plane comprising a plane having substantially zero degree of loft, which plane intersects the implement face but which is independent of the actual loft of the implement face, the implement shaft plane comprising a plane coinciding with the implement shaft and coinciding with the direction of travel of the implement shaft during the movement;

(d) emitting light from the at least one light emitting device, where the light has light characteristics that are determined by the orientation of the implement face plane relative to the implement shaft plane during the movement of the implement; and (e) displaying on a display device a visual representation of the movement of the implement, the visual representation based at least in part on the light characteristics of the light emitted from the at least one light emitting device.

17. A method for improving a person's movement of an implement along a desired path, the method comprising:

(a) providing an implement for the person to move, where the implement includes at least one motion characteristic sensor disposed thereon;

(b) generating motion characteristic signals using the motion characteristic sensor, where the motion characteristics are related to characteristics of the implement during the movement;

(c) generating biofeedback information signals indicative of positions of an implement face plane and an implement shaft plane of the implement during the movement, the biofeedback information signals based on the motion characteristic signals, the implement face plane comprising a plane having substantially zero degree of loft, which plane intersects the implement face but which is independent of the actual loft of the implement face, the implement shaft plane comprising a plane coinciding with the implement shaft and coinciding with the direction of travel of the implement shaft during the movement; and (d) providing biofeedback information to the person during the movement of the implement based on the biofeedback information signals, wherein the biofeedback information comprises one or more of video representations of the implement face plane and implement shaft plane displayed on a video display device, aural biofeedback information provided by audio speakers or audio headphones, and physical biofeedback information provided by vibration generating devices.

18. The method of claim 17 wherein the implement is selected from the group consisting of a golf club, a baseball bat, a softball bat, a tennis racket, a racquetball racket, an axe, a hammer and a maul.

19. A method for providing biofeedback regarding a rotational relationship of an implement face plane of an implement to an implement shaft plane of the implement during a person's movement of the implement along a desired path, the method comprising:

(a) providing the implement for the person to move, where the implement includes at least one motion characteristic sensor;

(b) generating motion characteristic signals using the motion characteristic sensor, where the motion characteristics are related to characteristics of the implement during the movement;

(c) generating biofeedback information signals during the movement of the implement based on the motion characteristic signals; and (d) providing biofeedback information based on the biofeedback information signals, where the biofeedback information indicates whether the movement exhibits an over-rotation or under- rotation of the implement face plane in relation to the implement shaft plane, and the biofeedback information is provided to the person during the movement in which the biofeedback information signals are generated, wherein the biofeedback information comprises one or more of video representations of the implement face plane and implement shaft plane displayed on a video display device, aural biofeedback information provided by audio speakers or audio headphones, and physical biofeedback information provided by vibration generating devices, wherein the implement face plane comprises a plane having substantially zero degree of loft, which plane intersects the implement face but which is independent of the actual loft of the implement face, and wherein the implement shaft plane comprises a plane coinciding with the implement shaft and coinciding with the direction of travel of the implement shaft during the movement.

20. The method of claim 19 wherein step (d) further comprises providing biofeedback information indicating whether the movement exhibits a behind-the- ideal-implement-shaft-plane error or a front-of-the-ideal-implement-shaft-plane error.

21. The method of claim 19 wherein the implement is a golf club, the movement is a swing of the golf club and step (d) further comprises providing biofeedback information indicating whether the movement exhibits one or more swing errors in a two plane merger zone of the swing, the swing errors selected from the group consisting of:

a behind-the-ideal-implement-shaft-plane with over-rotation error;

a behind-the-ideal-implement-shaft-plane with under-rotation error;

a behind-the-ideal-implement-shaft-plane and merged error;

an in-the-ideal-implement-shaft-plane with over-rotation error;

an in-the-ideal-implement-shaft-plane with under-rotation error;

a front-of-the-ideal-implement-shaft-plane with over-rotation error;

a front-of-the-ideal-implement-shaft-plane with under-rotation error; and a front-of-the-ideal-implement-shaft-plane and merged error.

22. The apparatus of claim 19 wherein step (d) further comprises providing biofeedback information indicating an ideal movement which exhibits an ideal in- the-ideal-implement-shaft-plane with merged condition in a two plane merger zone of the swing.

23. The method of claim 19 wherein the implement is a golf club, the movement is a swing of the golf club and step (d) further comprises providing biofeedback information indicating whether the swing exhibits an inside-out error or an outside-in error at an impact position of the swing.

24. The method of claim 19 wherein the implement is a golf club, the movement is a swing of the golf club and step (d) further comprises providing biofeedback information indicating whether the swing exhibits one or more swing errors at an impact position of the swing, where the swing errors are selected from the group consisting of:

a non-ideal inside-out with hook error;

a non-ideal inside-out with square error;

a non-ideal inside-out with slice error;

an ideal inside-out with hook error;

an ideal inside-out with slice error;

an outside-in with hook error;

an outside-in with square error; and an outside-in with slice error.

25. The method of claim 19 wherein the implement is a golf club, the movement is a swing of the golf club and step (d) further comprises providing biofeedback information indicating an ideal swing having an ideal inside-out with square condition at an impact position of the swing.

26. The method of claim 19 wherein the implement is selected from the group consisting of a golf club, a baseball bat, a softball bat, a tennis racket, a racquetball racket, an axe, a hammer and a maul.

27. The method of claim 19 further comprising:

(e) capturing video images of the person moving the implement;

(f) generating the biofeedback information signals comprising video representations of the implement face plane and the implement shaft plane of the implement; and (d) further comprising simultaneously displaying the video images and the video representations of the implement face plane and implement shaft plane on the video display device.

28. A motion trainer for improving a person's movement of an implement along a desired path, the motion trainer comprising:

an implement for the person to move, the implement having an implement shaft and an implement face;

at least one motion characteristic sensor disposed on the implement for generating motion characteristic signals indicative of positions of an implement shaft plane and an implement face plane during the movement of the implement by the person, the implement shaft plane comprising a plane coinciding with the implement shaft and coinciding with a direction of travel of the implement shaft during the movement, the implement face plane comprising a plane having substantially zero degree of loft, which plane intersects the implement face but which is independent of the actual loft of the implement face;

a computing device for receiving the motion characteristic signals and for generating biofeedback information signals based on the motion characteristic signals, the biofeedback information signals comprising one or more of video representations of the implement face plane and the implement shaft plane, aural biofeedback information, and physical biofeedback information; and at least one biofeedback device for receiving the biofeedback information signals from the computing device and for providing to the person biofeedback information based on the biofeedback information signals, the at least one biofeedback device comprising one or more of a video display device displaying the video representations of the implement face plane and implement shaft plane, audio speakers or audio headphones providing the aural biofeedback information, and vibration generating devices providing the physical biofeedback information.

29. The motion trainer of claim 28 wherein the at least one motion characteristic sensor comprises at least one accelerometer.

30. The motion trainer of claim 28 wherein the at least one motion characteristic sensor comprises at least one air pressure sensor.

31. The motion trainer of claim 28 wherein the video display device comprises video goggles.

32. The motion trainer of claim 28 wherein the at least one biofeedback device comprises at least one light emitting device disposed on the implement.

33. The motion trainer of claim 32 wherein the at least one light emitting device comprises at least one light emitting diode.

34. The motion trainer of claim 32 wherein the at least one light emitting device comprises at least one laser.

35. The motion trainer of claim 32 wherein the at least one light emitting device comprises a flexible organic light emitting device.

36. The motion trainer of claim 32 wherein the at least one biofeedback device comprises one or more columns of light emitting devices aligned with at least one axis of the implement.

37. The motion trainer of claim 36 wherein at least one of the columns of light emitting devices is aligned with the implement face plane of the implement and at least one of the columns of light emitting devices is aligned with the implement shaft plane of the implement.

38. The motion trainer of claim 37 wherein the light emitting devices in the at least one column aligned with the implement face plane emit light having a first color and the light emitting devices in the at least one column aligned with the implement shaft plane emit light having a second color that is distinct from the first color.

39. The motion trainer of claim 28 wherein the motion characteristic sensors generate signals related to at least one of a direction of the motion of the implement during the movement, an orientation of the implement during the movement, and a speed of the implement during the movement.

40. The motion trainer of claim 28 wherein the implement comprises a grip attached to the implement shaft and a golf club head attached to the implement shaft.

41. The motion trainer of claim 28 wherein the implement is selected from the group consisting of a golf club, a baseball bat, a softball bat, a tennis racket, a racquetball racket, an axe, a hammer and a maul.

42. A method for improving a person's movement of an implement along a desired path, the method comprising:

(a) providing an implement for the person to move, where the implement includes an implement shaft, an implement face, and at least one motion characteristic sensor attached to one or more of the implement shaft and implement face;

(b) generating motion characteristic signals using the at least one motion characteristic sensor, where the motion characteristics are indicative of positions of an implement shaft plane and an implement face plane during the movement of the implement by the person, the implement shaft plane comprising a plane coinciding with the implement shaft and coinciding with a direction of travel of the implement shaft during the movement, the implement face plane comprising a plane having substantially zero degree of loft, which plane intersects the implement face but which is independent of the actual loft of the implement face;

(c) generating biofeedback information signals based on the motion characteristic signals, the biofeedback information signals comprising video representations of at least one of the implement face plane and the implement shaft plane of the implement;

(d) capturing video images of the person moving the implement; and (e) displaying at least one of the video images of the person moving the implement, the video representations of the implement face plane, and the video representations of the implement shaft plane.

43. The method of claim 42 further comprising (f) providing to the person aural biofeedback information based on the biofeedback information signals.

44. The method of claim 42 further comprising (f) providing to the person physical biofeedback information based on the biofeedback information signals.

45. The method of claim 42 wherein the implement is selected from the group consisting of a golf club, a baseball bat, a softball bat, a tennis racket, a racquetball racket, an axe, a hammer and a maul.

* * * * *